US012761007B2

(12) United States Patent
Riboldi

(10) Patent No.: US 12,761,007 B2
(45) Date of Patent: Oct. 13, 2026

(54) SYSTEMS AND METHODS FOR WIRELESS ELECTRONIC BLASTING

(71) Applicant: Orica International Pte Ltd, Singapore (SG)

(72) Inventor: Adam Riboldi, Singapore (SG)

(73) Assignee: Orica International Pte Ltd, Singapore (SG)

( * ) Notice: Subject to any disclaimer, the term of this patent is extended or adjusted under 35 U.S.C. 154(b) by 0 days.

(21) Appl. No.: 18/876,982

(22) PCT Filed: Jun. 21, 2023

(86) PCT No.: PCT/SG2023/050436

§ 371 (c)(1),
(2) Date: Dec. 19, 2024

(87) PCT Pub. No.: WO2023/249559

PCT Pub. Date: Dec. 28, 2023

(65) Prior Publication Data

US 2026/0022925 A1 Jan. 22, 2026

(30) Foreign Application Priority Data

Jun. 22, 2022 (SG) ..... 10202250251M

(51) Int. Cl.
*F42D 1/045* (2006.01)
*F42D 1/10* (2006.01)
*F42D 1/22* (2006.01)

(52) U.S. Cl.
CPC ..... *F42D 1/045* (2013.01); *F42D 1/10* (2013.01); *F42D 1/22* (2013.01)

(58) Field of Classification Search
CPC . F42D 3/04; F42D 1/045; F42D 1/055; F42D 1/08; F42D 1/00; F42D 1/10;
(Continued)

(56) References Cited

U.S. PATENT DOCUMENTS 4,498,392 A * 2/1985 Billard ..... F42B 5/15 102/357
4,519,315 A * 5/1985 Arszman ..... F42B 12/10 102/377
(Continued)

FOREIGN PATENT DOCUMENTS

CA 2375483 A1 12/2000
CA 3185519 A1 1/2022
(Continued)

OTHER PUBLICATIONS

International Search Report and Written Opinion of International Searching Authority for Application No. PCT/SG2023/050436, mailed Aug. 29, 2023 (8 pages).
(Continued)

*Primary Examiner* — Michael D David
(74) *Attorney, Agent, or Firm* — Nixon Peabody LLP

(57) ABSTRACT

Disclosed herein are systems and methods/processes for wireless electronic blasting (WEB), in particular for commercial/civil blasting operations that use wireless blasting-related devices that are deployable or deployed within portions of a physical medium (e.g., a rock formation) intended to be blasted as part of a commercial/civil blasting operation.

20 Claims, 21 Drawing Sheets

(58) Field of Classification Search
CPC . F42D 1/22; E21B 7/025; E21D 9/006; G06F 30/20; G06F 30/00
USPC ..... 102/312, 200, 301, 302, 313; 175/2, 24, 175/57, 4.55–4.59; 702/11; 89/1.15
See application file for complete search history.

(56) References Cited

U.S. PATENT DOCUMENTS

| | | | | |
|---|---|---|---|---|
| 8,196,514 | B2 * | 6/2012 | Gustafsson | F42B 12/62 102/489 |
| 8,314,374 | B2 * | 11/2012 | Uzman | B64U 50/13 244/3.13 |
| 9,598,172 | B2 * | 3/2017 | Markov | B64D 1/16 |
| 10,267,611 | B2 | 4/2019 | Lownds et al. | |
| 10,914,167 | B2 | 2/2021 | Scott et al. | |
| 10,920,572 | B2 | 2/2021 | Ratcliffe et al. | |
| 11,293,245 | B2 | 4/2022 | Stewart et al. | |
| 11,485,495 | B1 * | 11/2022 | Gyurek | B64D 1/04 |
| 12,287,649 | B2 * | 4/2025 | Choi | F42D 1/045 |
| 12,454,361 | B1 * | 10/2025 | Salois | B64D 25/10 |
| 2008/0134923 | A1 * | 6/2008 | Lownds | F42D 3/04 102/215 |
| 2009/0283004 | A1 * | 11/2009 | Teowee | H04L 25/0262 102/215 |
| 2010/0300317 | A1 * | 12/2010 | Leppanen | F42B 3/00 102/206 |
| 2012/0137914 | A1 * | 6/2012 | Nelson | F42B 35/00 102/215 |
| 2013/0019587 | A1 * | 1/2013 | Hoffman | F02K 9/80 29/890.01 |
| 2014/0069289 | A1 * | 3/2014 | DeVries | F42B 15/36 102/202 |
| 2019/0316461 | A1 | 10/2019 | Cavanaugh | |
| 2020/0096299 | A1 * | 3/2020 | Naud | F41F 1/06 |
| 2021/0215037 | A1 | 7/2021 | Stewart | |
| 2021/0318107 | A1 | 10/2021 | Maurissens et al. | |
| 2023/0287791 | A1 | 9/2023 | Uchida | |
| 2024/0182145 | A1 * | 6/2024 | Carr | B63G 9/02 |
| 2024/0367811 | A1 * | 11/2024 | Rosenkrantz | B64D 37/12 |
| 2025/0067544 | A1 * | 2/2025 | Murarash | F42B 5/28 |
| 2025/0269962 | A1 * | 8/2025 | Keller, Jr. | B64D 7/00 |

FOREIGN PATENT DOCUMENTS

| | | | | |
|---|---|---|---|---|
| GB | 2389601 | A | 12/2003 | |
| WO | WO-2021080513 | A1 * | 4/2021 | G06K 19/0723 |
| WO | 2021161103 | A1 | 8/2021 | |
| WO | 2022019841 | A1 | 1/2022 | |
| WO | WO 2022/014530 | A1 | 1/2022 | |
| WO | WO-2022099356 | A1 * | 5/2022 | F42D 1/10 |
| WO | 2022196570 | A1 | 9/2022 | |

OTHER PUBLICATIONS

Notice of Opposition filed in Chilean Patent Application No. 202403954, dated Jul. 14, 2025, partially in Spanish (224 pages).
Extended European Search Report in European Patent Application No. 23827617.4, dated Apr. 17, 2026 (8 pages).
PTO Resolution regarding Opposition filed in Chilean Patent Application No. 202503044, dated Jul. 17, 2026, with English translation (31 pages).

* cited by examiner

SYSTEMS AND METHODS FOR WIRELESS ELECTRONIC BLASTING

RELATED APPLICATION

This application is a U.S. National Stage of International Application No. PCT/SG2023/050436, filed Jun. 21, 2023, which claims priority to and the benefit of Singapore patent application Ser. No. 10202250251M, filed Jun. 22, 2022, each of which is hereby incorporated by reference herein in its entirety.

TECHNICAL FIELD

Disclosed herein are systems and methods/processes for wireless electronic blasting (WEB), in particular for commercial/civil blasting operations that use wireless blasting-related devices that are deployable or deployed within portions of a physical medium (e.g., a rock formation) intended to be blasted as part of a commercial/civil blasting operation.

BACKGROUND

In commercial/civil blasting operations, boreholes are narrow shafts that may be bored into rock vertically downwards (into a floor), vertically upwards (into a roof), horizontally (into a wall), or at an angle between vertical and horizontal depending on the blast pattern required.

For blasting, bulk explosive material (which can be a bulk explosive product) is filled into the boreholes, along with suitable initiation devices (e.g., detonators), and an explosive "train" is then triggered in a planned sequence based on a predetermined blast plan.

Wireless electronic initiation devices, e.g., detonators triggered by radio signals, may be used to avoid complicated wired connections. Wireless electronic blast monitoring/tracking devices (or "markers") may be used to track movement in a physical medium (e.g., a rock formation) being blasted. The wireless electronic initiation devices may give rise to new blasting techniques not previously feasible with conventional wire-based initiation devices (e.g., wired detonators). The wireless markers may allow for movement monitoring not previously feasible with conventional movement monitoring tools (e.g., surface stakes).

Existing systems and methods for transporting, assembling, encoding and deploying wireless blasting-related devices can still be undesirably labour-intensive (e.g., requiring two or more skilled people working together), dangerous for the people working on the mine site, time-consuming and/or unreliable.

In examples, one or more wireless electronic initiation devices are manually deployed into a blasthole before or after the blasthole has been (partially) filled with a bulk explosive material. In an example, deploying a wireless electronic initiation device in the form of a wireless primer may include laborious manual tasks such as:

a. inserting a stake at the collar of the blasthole;
b. attaching a tether to the end of the wireless primer;
c. manually programming the wireless primer;
d. lowering the wireless primer down the blasthole to the desired position; and
e. tying the tether off to the stake.

A multitude of primers may be required by the blast plan, along with a multitude of different bulk explosive materials, in one blasthole, making the conventional method even more laborious.

It is desired to address or ameliorate one or more disadvantages or limitations associated with the prior art, or to at least provide a useful alternative.

SUMMARY

Disclosed herein is a system (a "deployment system" or a "deploy system", for commercial/civil blasting) including:

a deployment device (202) configured to secure a wireless device (104) while the wireless device (104) is being deployed into/in/along a borehole (106); and a deploy control system (208) in operative communication with the deployment device (202), configured to control an extension control mechanism (206) to guide the deployment device (202) into/in/along the borehole (106), and configured to control (remotely) the deployment device (202) to release/eject the wireless device (104) at/to a predefined/selected operational location in the borehole (106).

The deployment device (202) may include a securing arrangement to secure the wireless device (104) in a secure position in/on the deployment device (202) by applying a retaining force on/to the wireless device (104), and the securing arrangement may include: (a) a passive securing arrangement that applies the securing force without an activation signal; and/or (b) an active securing arrangement that applies the securing force in response to an activation signal.

The system may include a depth sensor system configured to provide a depth signal for the deploy control system (208) to automatically determine that the wireless device (104) is at the predefined/selected operational location.

The deployment device (202) may be configured to eject the wireless device (104) from the deployment device (202) by applying an ejection force to the wireless device (104) to eject the wireless device (104) at/to the predefined/selected operational location.

The deployment device (202) may include an ejection mechanism to provide the ejection force. The ejection mechanism may include: (a) a passive ejection mechanism that applies the ejection force with stored potential energy; and/or (b) an active ejection mechanism that applies the ejection force with power/energy from a power/energy source.

The system may include a link (204) configured to hold and guide (including to force/drive/draw/lower/raise) the deployment device (202) into/in/along the borehole (106) substantially to the predefined/selected operational location.

The system may include a dispense system (108) with: a delivery conduit (302) (also referred to as a "delivery conduit assembly") configured to carry one or more bulk explosive materials into the borehole (106); and a dispense control system (308) configured to control the dispense system (108) to automatically dispense the bulk explosive materials into the borehole (106) coordinated with the deployment of the wireless device (104) at its predefined/selected operational location.

The link (204) may include the delivery conduit (302).

The wireless device (104) may include:

a wireless initiation device (e.g., with a wireless electronic detonator, or electronic detonator) configured to initiate the bulk explosive materials, optionally in the form of a wireless primer with booster explosive charge to initiate the bulk explosive materials; or a wireless marker (also referred to as a "(blast) tracking device", "(blast) (movement) marker", "blast movement monitor" or "(blast) monitoring device").

The wireless device (104) may be moved into/in/along the borehole (106), including at least partially to the predefined/selected operational location, by way of the deployment device (202) being forced/driven/drawn/lowered/raised into/in/along the borehole (106) with the wireless device (104) secured/held/retained by the deployment device (202).

Disclosed herein is a method/process ("deployment method" or "deploy method" for commercial/civil blasting) including:

- securing a wireless device (104) in/to a deployment device (202) while the deployment device (202) is being forced/driven/drawn/lowered/raised in/into/along a borehole (106);
- controlling an extension control mechanism (206) to guide the deployment device (202) into/in/along the borehole (106); and
- controlling (remotely) the deployment device (202) to release/eject the wireless device (104) at/to a predefined/selected operational location in the borehole (106).

BRIEF DESCRIPTION OF THE DRAWINGS

Some embodiments of the present invention are hereinafter described, by way of example only, with reference to the accompanying drawings, in which.

a.

b.

c.

d.

e.

f.

g.

h.

i.

j.

k.

l.

m.

n.

o.

p.

q.

r.

s.

t.

u.

v.

w.

x.

y.

z.

aa.

bb.

cc.

dd.

DETAILED DESCRIPTION

Overview

Described herein is a deployment system and method/process (also referred to as a "deploying" system and method, or a "deploy" system and method) for: deployment of wireless devices related to commercial blasting (which may be referred to as "wireless blasting-related devices" or "blasting-related wireless devices", and are referred to as "wireless devices" hereinafter) into one or more boreholes for use in a wireless electronic blasting system (WEBS) for commercial/civil blasting operations, specifically for wireless electronic blasting (WEB), e.g., WEB devices.

The deploy system and method may also be for delivery of one or more bulk explosive materials (including combined bulk explosives components, e.g., tertiary high explosives materials) into the borehole (which may thus be referred to as a blasthole)—this delivery may be referred to as "blasthole charging".

Each wireless device is configured for deployment in the borehole, which is in a physical medium (e.g., a rock formation), portions of which are intended to be blasted as part of a commercial/civil blasting operation.

The deploy method may include holding, storing, carrying, transporting, dispensing, and/or assembling the wireless device. The deploy system may be configured to perform the deploy method.

The deploy method and system may be mechanized, mechanizable, automated, or automatable such that manual labour is reduced.

Each wireless device may include:

a. a wireless initiation device (e.g., a wireless electronic detonator) configured to initiate the bulk explosive materials;

b. a wireless primer, including a wireless initiation device and a corresponding booster configured to initiate the bulk explosive materials; or c. a wireless marker (also referred to as a "(blast) tracking device", "(blast) (movement) marker", "blast movement monitor" or "(blast) monitoring device").

Deploy System 100

Figure 1:
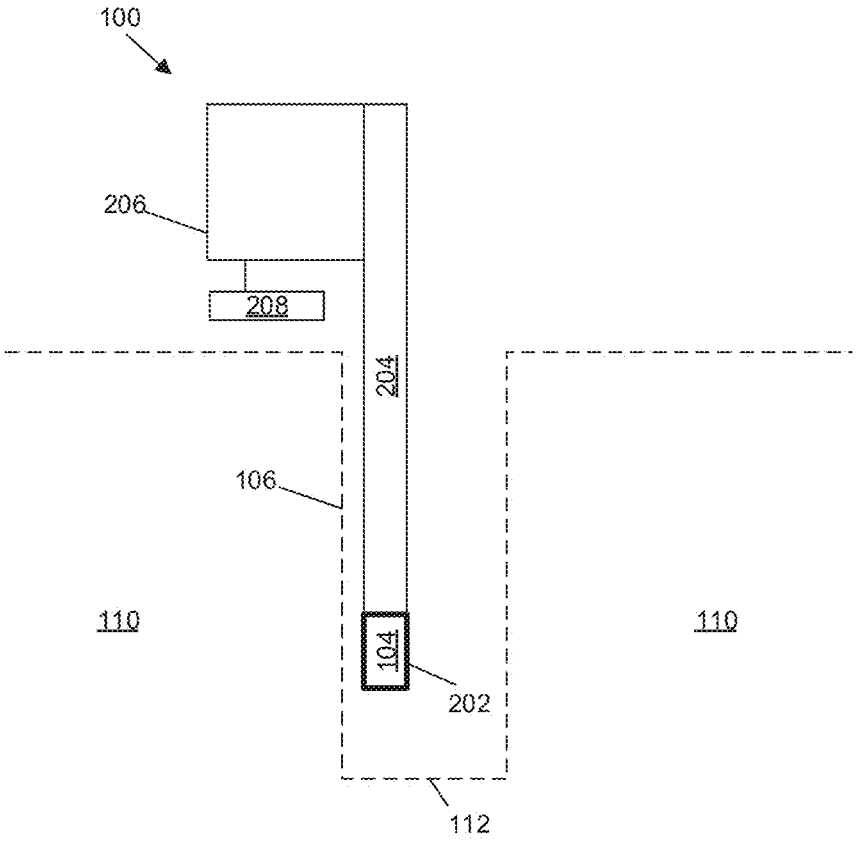
FIG. 1 is a side-view schematic diagram of a deploy system partially in a borehole (shown in cross section)

As shown in FIG. 1, a deploy system 100 (also referred to as a "deployer system" or "deployment system") is configured to deploy a wireless blasting-related device 104 (referred to herein as a "wireless device") into a borehole 106 (which may be a blasthole) for underground/surface commercial/civil blasting operations. The deploy system 100 may include:

a. a deployment device 202 (also referred to as a "deploy housing", "deployment housing", "head" or "head unit") that is configured to secure/hold/retain the wireless device 104 in/to itself while the wireless device 104 is moved into/in/along the borehole 106 to a predefined/selected operational location for the wireless device 104 in the borehole 106 (including by way of the deployment device (202) being forced/driven/drawn/lowered/raised into/in/along the borehole (106) with the wireless device 104 secured/held/retained by the deployment device (202))—the predefined/selected operational location may be selected/defined in a blasting plan, and may be at or close to a toe 112 (i.e., end) of the borehole 106, including in the bulk explosive materials of the blasthole, wherein the deployment device 202 is also configured to be controlled to release/eject the wireless device 104 at/to its predefined/selected operational location;

b. a flexible elongate member (which is also referred to as a "connecting member", "line" or "link 204") connected to the deployment device 202 and configured to hold and guide (including to force/drive/draw/lower/raise) the deployment device 202 into/in/along the borehole 106 substantially to the predefined/selected operational location for delivery/ejection of the wireless device 104;

c. an extension control mechanism 206 (which may include a hoist), configured to operate while substantially out of the borehole 106, connected to the link 204 (at the other end of the link 204 from the housing 202) and configured to control position and extension of the link 204 to guide the wireless device 104 substantially to its operational location while in/on the deployment device 202; and d. a deploy control system 208 in operative communication with the extension control mechanism 206 and with the deployment device 202, configured to control the extension control mechanism 206 to guide the deployment device 202 into/in/along the borehole 106, and configured to control (remotely) the deployment device 202 to release/eject the wireless device 104 to its predefined/selected operational location.

Figure 2:
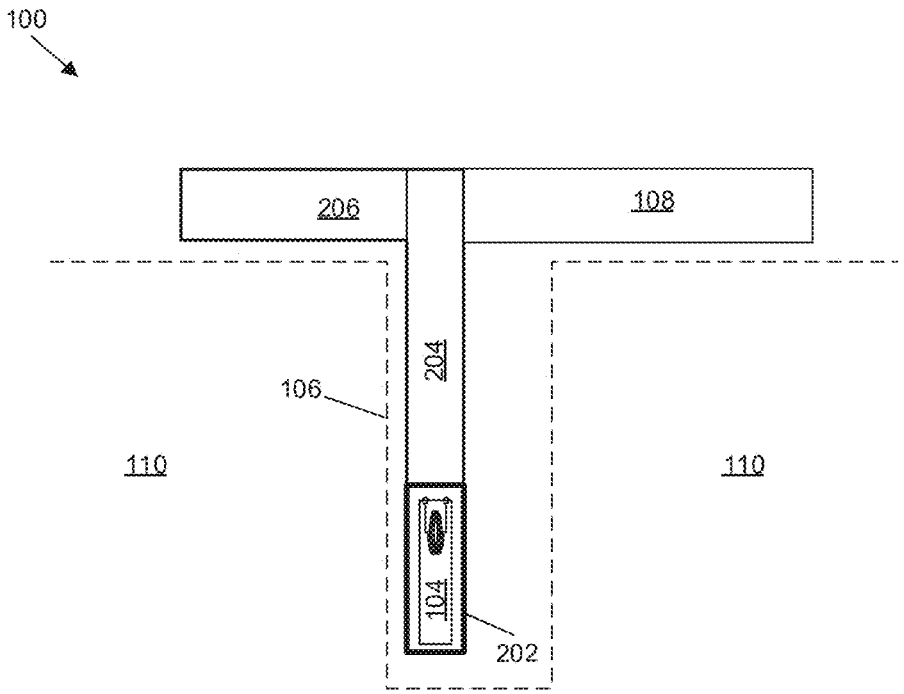
FIG. 2 is a side-view schematic diagram of the deploy system with a dispense system that is partially in a borehole (shown in cross section)

As shown in FIG. 2, the deploy system 100 may include a dispense system 108 (also referred to as a "dispensing system") configured to dispense one or more bulk explosive materials into the borehole 106 (which is then referred to as a blasthole).

Figure 3:
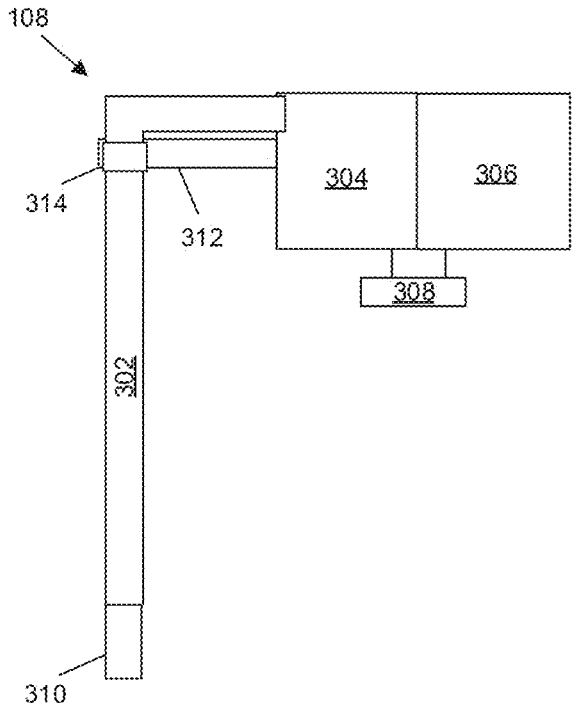
FIG. 3 is a side-view schematic diagram of the dispense system.

As shown in FIG. 3, the dispense system 108 includes: a delivery conduit 302 (also referred to as a "delivery conduit assembly") configured to carry the one or more bulk explosive materials into the borehole 106; and a dispense control system 308 configured to control the dispense system 108 to automatically dispense the bulk explosive materials into the borehole 106 coordinated with the deployment of the wireless device 104 at its predefined/selected operational location in the following method:

a. the dispense system 108 extends the delivery conduit 302 into the borehole 106;

b. the dispense system 108 fills the bulk explosive materials via the delivery conduit 302 into the toe 112, typically a small volume, to a first selected depth from the toe 112 (e.g., as defined in the blast plan)—this step may be referred to as laying a toe charge;

c. the deploy control system 208, on receiving an indication that the selected depth of the has been filled into the toe 112 (e.g., from the dispense control system 308), controls the deployment device 202 to release/eject the wireless device 104 to its predefined/selected operational location (which may then be referred to as the "deployed" position/location) into/onto the bulk explosive materials in the toe 112—the wireless device 104 may then be sufficiently suspended/embedded/encapsulated in the bulk explosive materials such that the wireless device 104 substantially does not move along the borehole 106 from its predefined/selected operational location—this step may be referred to as deploying the wireless device 104; and d. the dispense system 108 fills the bulk explosive materials into the borehole 106 beyond the now-embedded wireless device 104, typically a large volume (compared to the toe volume), to a second selected depth from the toe 112 (e.g., as defined in the blast plan)—this step may be referred to as loading the remaining material/product.

The deploy system 100 may include a depth sensor system, including a movement sensor (referred to as a "link movement sensor", e.g., including an encoder, as described hereinafter) configured to measure longitudinal movement/extension/depth of the link 204, and/or an in-hole sensor component configured to operate at the depth of the deployment device 202, to automatically estimate/measure/calculate/determine a relative depth or depth of the deployment device 202 in the borehole 106, at least prior to the deployment device 202 being controlled to release/eject the wireless device 104 to its predefined/selected operational location. The deploy control system 208 is in communication with the depth sensor system such that deployment device 202 can automatically control the release/ejection of the wireless device 104 at/to its predefined/selected operational location (which may include a hole depth in the borehole 106 (a "predefined loading depth"), a unique identifier of the borehole 106, and/or a geographical location, all defined in a blast plan), e.g., according to blast plan data (representing the blast plan) that is automatically accessible by the deploy system 100.

Deployment Device 202

The deployment device 202 is guided into the borehole 106 by the deploy system 100 such that one end of the housing ("proximal end") is closer to the other end of the housing ("distal end" or "toe end"), and the distal end is closer to the toe 112 than the proximal end.

The deployment device 202 is configured to protect the wireless device 104 during deployment into the borehole 106, e.g., from impacts with the borehole walls. The deployment device 202 may include a material with high wear and corrosion resistance, e.g., including one or a combination of stainless steel, hardened steel (e.g., bisalloy). The deployment device 202 may include a water-resistant resilient materials, including rubber/plastic, forming fluid seals and resilient/spring elements as described hereinafter.

The deployment device 202 may include sufficient weight to mitigate any floatation force, e.g., from water/product in the borehole 106, that would misalign the deployment device 202 from substantially following a central axis of the borehole 106. The deployment device 202 may have sufficient weight, e.g., including the steel, to pull the link 204 down the borehole 106, including to penetrate water, mud, bulk explosive materials, etc., in the borehole 106.

Figure 4:
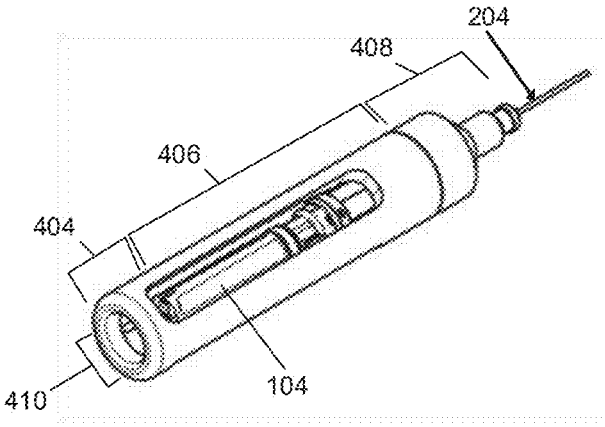
FIG. 4 is perspective-view diagram of a deployment device of the deploy system.

The deployment device 202 can have an outer shape that is configured to allow the deployment device 202 to penetrate/travel into/along the borehole 106. The outer shape may include a pointed/sharp leading end/tip/cap—with a triangular shape tip, a V-shape, a U-shape, or a bullet shape—that is configured/shaped to penetrate mud and/or loose rock, and to guide the deployment device 202 around/past uneven borehole walls/rocks, in order to guide the deployment device 202 along the borehole 106 as it is lowered/pushed down/along/into the borehole 106. As shown in FIG. 4, the outer shape of the deployment device 202 can include a proximal portion 408 (at the proximal end), a distal portion 404 (at the distal end), and an intermediate portion 406 between the proximal portion 408 and the distal portion 404. The pointed/sharp leading end/tip/cap is at the distal end in the distal portion 404. As shown in FIG. 4, the pointed/sharp leading end/tip/cap may include a hollow tip that is configured to release the wireless device 104; however, in other implementations, the pointed/sharp leading end/tip/cap is substantially closed to improve penetration. As shown in FIG. 4, the outer shape can include a substantially cylindrical shape. The deployment device 202 may include an outer casing/body that defines the outer shape. The outer casing/body can seal and protect the electronic components and fluidic passages/values of the deployment device 202 (described hereinafter) such that they are sealed/protected against fluid ingress and impact damage within the outer casing/body. The outer casing/body may include steel elements, e.g., a stainless steel shell welded/fastened to form the outer casing/body. The outer casing/body may have a substantially cylindrical outer shape, e.g., with a diameter of 100 mm to 150 mm, and a length of 500 mm to 650 mm.

The deployment device 202 may include an internal cavity configured/shaped to receive the wireless device 104 substantially within the deployment device 202, e.g., such that the wireless device 104 is substantially protected by the deployment device 202 from the bumps/impacts. The internal cavity may be shaped/configured to allow free travel of the wireless device 104 into and out of the deployment device 202, mitigating snagging upon exit or insertion. The wireless device 104 may be ejected/released into the bulk explosive materials, water, mud or a mixture, and the ejection mechanism may include providing fluid to the internal cavity, and such fluids/water/bulk materials/etc., which may aid in lubrication between the wireless device 104 and the deployment device 202 during ejection/release thereof.

The deployment device 202 may be configured to receive wireless devices 104 with the following outer dimensions (thus dimensions of an outer housing/shell of the wireless device):

a. a substantially spherical/cylinder shape with a diameter of 20 mm to 100 mm, and a length of 100 mm to 300 mm;
b. a substantially cylinder shape with a diameter of substantially 60 mm and a length of substantially 150 mm, e.g., of a wireless marker or blast movement monitor;
c. a substantially spherical shape (or "ball shape") with a diameter of substantially 100 mm, e.g., of a wireless marker or blast movement monitor;
d. a substantially cylinder shape with a diameter of substantially 34 mm and a length of substantially 330 mm, e.g., of an underground primer;
e. a substantially cylinder shape with a diameter of substantially 48 mm and a length of substantially 386 mm, e.g., of an medium surface primer; and/or
f. a substantially cylinder shape with a diameter of substantially 60 mm and a length of substantially 386 mm, e.g., of a large surface primer.

The internal cavity of the deployment device 202 may include an opening ("housing opening") to receive the wireless device 104. The housing opening may include an end opening (or "end portal" or "end hole") in the distal end of the deployment device 202 that is configured (having a cross-sectional opening larger than a maximum axial cross-section of the wireless device 104) to allow the wireless device 104 to enter the deployment device 202, and to exit the deployment device 202 through the distal end (thus substantially along a longitudinal axis of the deployment device 202) when released by the securing arrangement and/or ejected by the ejection mechanism. The housing opening may include a side opening (or "side portal", "side hole" or "intermediate opening/portal/hole") in a side (between the distal end and the proximal end) of the intermediate portion of the deployment device 202 that is configured (having a cross-sectional opening larger than a maximum cross-section of the wireless device 104, including a length longer than a maximum length of the wireless device 104 and a width wider than a maximum width/diameter of the wireless device 104) to allow the wireless device 104 to enter the deployment device 202 and to exit the deployment device 202 through the side of the intermediate portion when released by the securing arrangement and/or ejected by the ejection mechanism. As shown in FIG. 4, FIG. 7B, FIG. 10A, FIG. 10B and FIG. 12A, the deployment device 202 may include an example end opening 410 (or "end portal" or "end hole") in the distal end of the deployment device 202 that is configured (having a cross-sectional opening larger than a maximum axial cross-section of the wireless device 104) to allow the wireless device 104 to exit the deployment device 202 through the distal end when released by the securing arrangement and/or ejected by the ejection mechanism. As shown in FIG. 4, FIG. 11B, FIG. 11C, FIG. 13A, FIG. 13C and FIG. 13F, the deployment device 202 may include an example side opening 512 (or "side portal", "side hole" or "intermediate opening/portal/hole") in a side of the intermediate portion of the deployment device 202 that is configured (having a cross-sectional opening larger than a maximum cross-section of the wireless device 104, including a length longer than a maximum length of the wireless device 104 and a width wider than a maximum width/diameter of the wireless device 104) to allow the wireless device 104 to exit the deployment device 202 through the side of the intermediate portion when released by the securing arrangement and/or ejected by the ejection mechanism.

Link 204

Figure 5:
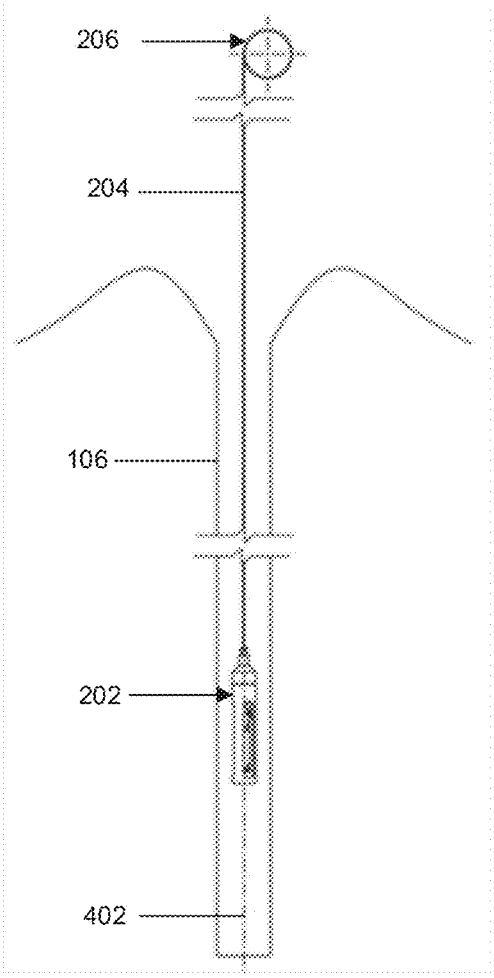
FIG. 5 is a side-view schematic diagram of the deploy system with a link to the deployment device in a borehole (shown in cross section)

As shown in FIG. 5, the link 204 is connected/secured to the extension control mechanism 206 and to the deployment device 202.

The deployment device 202 can be extended into (e.g., lowered down) the borehole 106 along the borehole axis 402 ("blasthole axis") by the link 204 being driven by the extension control mechanism 206.

The link 204 is formed of substantially longitudinally inflexible material such that a longitudinal section of the link 204 has a substantially inflexible length—this may assist with determining a depth of the deployment device 202 in the borehole 106 based on measuring portion(s) of the link 204 extending into the borehole 106.

The link 204 may include a link body that is substantially rigid under longitudinal tension, e.g., a line/cord/cable/rope/hose/chain, which may be useful for downholes where gravity tends to keep the link 204 in tension.

The link 204 may include a link body that is substantially rigid under longitudinal compression, e.g., a hose/noodle/snake, which may be useful for upholes where gravity tends to keep the link 204 in compression.

The link 204 may include a link body that is substantially rigid under longitudinal compression and tension, e.g., a hose/noodle/snake, which may be useful for upholes and downholes.

If the link body is substantially rigid under longitudinal tension, the link 204 may include a line of an independent mechanical apparatus described in the Singapore Provisional Patent Application No. 10202113093T filed 25 Nov. 2021 in the name of Orica International Pte Ltd.

If the link body is substantially rigid under longitudinal compression (and tension), the link 204 may include a hose/pipe/tube of a dispenser system described in Singapore Provisional Patent Application No. 10202113093T filed 25 Nov. 2021 in the name of Orica International Pte Ltd.

The link 204 may include a wireline cable including one or more electrical conductors ("link electrical conductors") or a conductive cable/wire. The wireline cable may be electrically connected to the deployment device 202, including to control the deployment device 202 to release/eject the wireless device 104. The wireline cable may be electrically connected to the depth sensor component in order to receive depth signals therefrom. The wireline cable may be electrically connected to and/or in communication with the deploy control system 208 to control the deployment device 202 and/or to deliver the depth signals for use by the deploy control system 208. The wireline cable may be in a sealed core or sheath of the link 204.

The link 204 may include: at least one hose/channel ("pressure hose/channel") for providing positive/negative fluid pressure for the securing arrangement (via "securing fluid" described hereinafter) and/or the ejection mechanism (via "ejection fluid" described hereinafter). The pressure hose/channel may be in a sealed core or sheath of the link 204, e.g., with other elements of the link 204 such as the electrical conductors and/or the delivery conduit 302.

Figure 6:
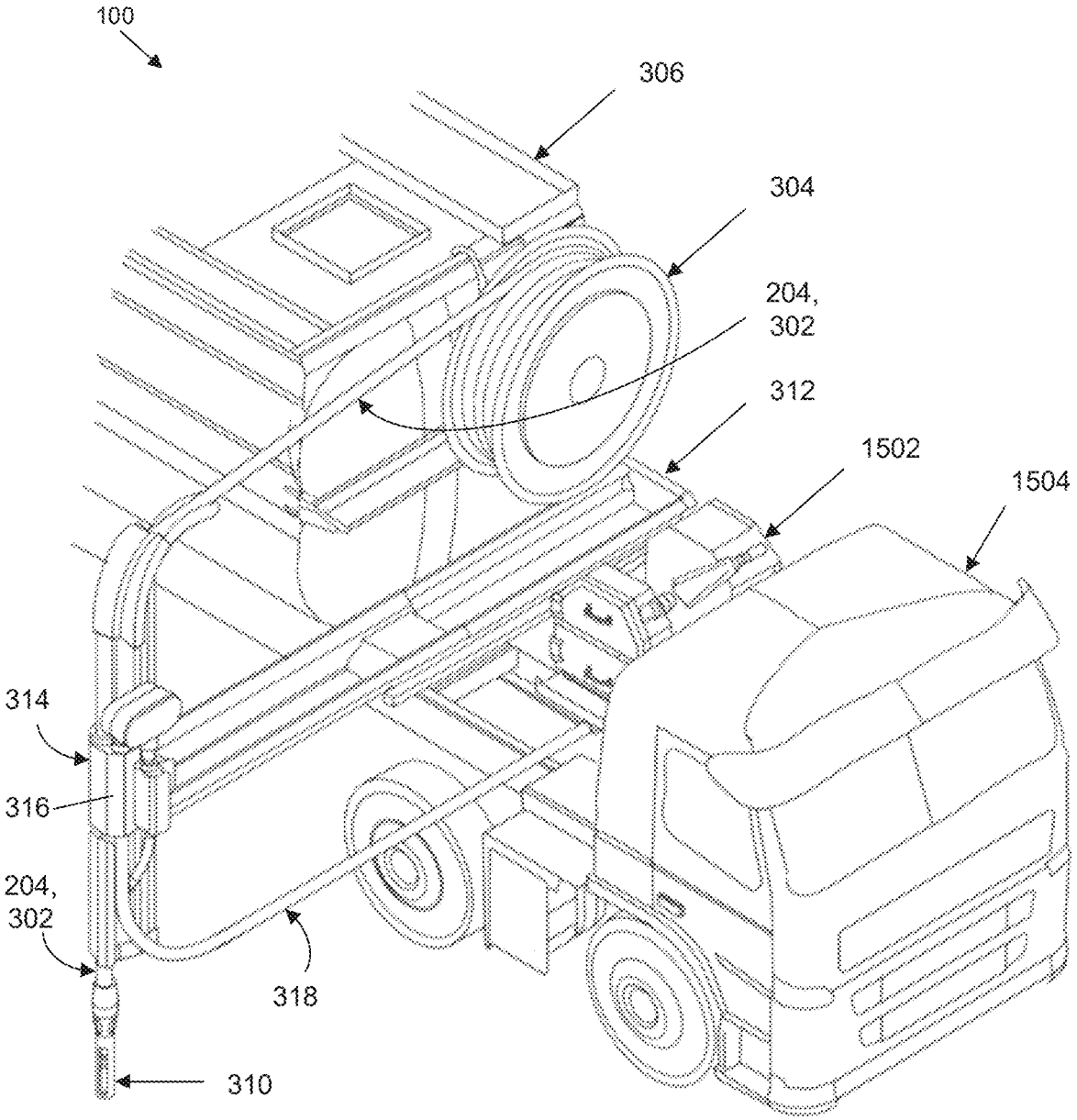
FIG. 6 is a perspective-view diagram of the deploy system with a mechanized platform/vehicle.

As shown in FIG. 6, the link 204 may include the delivery conduit 302 of the dispense system 108.

Extension Control Mechanism 206

The extension control mechanism 206 is configured to guide/force/drive/draw/lower/raise the link 204 into/in/along and/or out of the borehole 106. The extension control mechanism 206 can include a pulling mechanism, e.g., a winch (for downholes, wherein the link 204 is substantially rigid under longitudinal tension). The extension control mechanism 206 can include a pushing mechanism, e.g., a driver of the link 204 (for upholes or upwardly angled boreholes and/or substantially horizontal boreholes, wherein the link 204 is substantially rigid under longitudinal compression) mechanically and longitudinally connected to the link 204.

In an example, the link 204 may include a cord/cable of a dip-and-bob device and the extension control mechanism 206 may include a motor of a dip and bob device, e.g., from a dip-and-bob device used for augured bulk explosive materials.

If the link 204 includes the line of the independent mechanical apparatus described in the Singapore Provisional Patent Application No. 10202113093T filed 25 Nov. 2021 in the name of Orica International Pte Ltd, the extension control mechanism 206 may include a line-driving mechanism of the independent mechanical apparatus If the link 204 includes the hose/pipe/tube of the dispenser system described in Singapore Provisional Patent Application No. 10202113093T filed 25 Nov. 2021 in the name of Orica International Pte Ltd, the extension control mechanism 206 may include a hose reel/motor system of the dispenser system.

Deploy Control System 208

The deploy control system 208 controls the location and/or timing for ejection/deployment of the wireless device 104.

The deploy control system 208 is configured and connected to the depth sensor system (via a signal input (e.g., an electronic interface)) to receive depth signals (from the depth sensor system) representing the (current) depth of wireless device 104 carried by the housing 202 in the borehole 106, in particular as it reaches its predefined/selected operational location.

The deploy control system 208 may include a microcontroller with signal inputs/outputs and machine-readable memory defining the operation of the deploy control system 208.

The deploy control system 208 may be integrated with or incorporated into the dispense control system 308, which may include the LOADPlus™ system from Orica Group™.

Dispense System 108

As described hereinbefore, for blasting, the deploy system 100 can fill the blast explosive materials into the ends or "toes 112" of a plurality of the boreholes 106 (blastholes), into which the deploy system 100 can automatically place a plurality of the wireless devices 104 (which include suitable initiating systems, e.g., wireless electronic initiators, e.g., WebGen 200™ from Orica Group™), and an explosive train can then triggered in a planned sequence of the wireless devices 104 based on the blast plan. A multitude of pre-drilled blastholes on a blast site or bench may be charged in this manner according to the blast plan.

As shown in FIG. 3, the dispense system 108 may include:

a. the delivery conduit 302 (or "delivery conduit assembly") configured to carry the one or more bulk explosives materials into the borehole 106;

b. a hose reel 304 (or "winder" or "winch") configured to carry (i.e., "bear") the conduit 302 that is configured to extend (i.e., push/lower) the conduit 302 into the borehole 106 prior to loading of the bulk explosive materials, and to withdraw (i.e., pull) the conduit 302 from the borehole 106 after the loading, thus controlling the depth of the conduit 302 along the borehole 106;

c. a mixing/delivery system 306 (also referred to as a "Fluid Delivery System") connected to the hose reel 304 that is configured to deliver (e.g., pump/auger) the bulk explosive materials (which might include mixing components) to the hose reel 304 (e.g., hose reel 304 is connected to at least one product pump/auger of the mixing/delivery system 306);

d. a dispense control system 308 in communication with the hose reel 304 and the mixing/delivery system 306 and configured to:

i. control the mixing/delivery system 306 to dispense the bulk explosive materials when the hose reel 304 has extended the conduit 302 to an operational depth in the borehole 106, and ii. control the hose reel 304 to extend and to withdraw the conduit 302;

e. a nozzle 310 connected to a free end portion (or "distal end" portion) of the conduit 302 and configured to dispense the bulk explosive materials into the borehole 106;

f. a hose boom 312 connected to and bearing the conduit 302 that is configured to control a surface location of the conduit 302 across a surface of the media 110, i.e., substantially transverse to a direction of the borehole 106 into the surface; and g. a boom head 314, through which the conduit 302 routes, configured to provide substantially free longitudinal movement of the conduit 302, including for extension and withdrawal thereof, but to substantially limit uncontrolled movement of the conduit 302 across the surface, i.e., to control via the boom 312 where the conduit 302 is held across the surface so that the conduit 302 remains aligned with the axis 402 during extension, delivery and withdrawal.

As shown in FIG. 6, the deploy system 100 may include a mechanized platform/vehicle 1504 configured for containing and safely transporting the explosives materials/components. The mechanized platform/vehicle 1504 includes tanks and bins to store the explosives materials, including storing mutually different components separately, ready for mixing by the mixing/delivery system 306 to form at least one bulk explosive product of the bulk explosive materials. The platform/vehicle 1504 carries and powers the dispense system 108, including from an electrical power source, e.g., a vehicle alternator, generator and/or battery storage. The mechanized platform/vehicle 1504 may include a self-propelled vehicle, for instance, a truck or prime mover.

The delivery conduit 302 may include a bulk hose configured to hold/carry the bulk explosive materials under pressure to the nozzle 310. The bulk hose is connected to the extension control mechanism 206 and to the nozzle 310. The bulk hose, e.g., a surface bulk delivery hose, may have an inner diameter of 15 mm to 65 mm (e.g., substantially 18.5 mm), and outer diameter of 25 mm to 75 mm (e.g., 27.5 mm), a minimum bend radius of 100 mm to 1 m (e.g., substantially 500 mm), a non-conductive body material (e.g., non-conductive high-density polyethylene), and a high tensile strength reinforcing material (e.g., Kevlar™) The bulk hose may for example include a Powerhose™ from Orica Group™.

The reel 304 manages the delivery conduit 302, i.e., keeps the delivery conduit 302 arranged in the dispense system 108 ready for extension down the borehole 106. The reel 304 fluidly connects the conduit 302 to the mixing/delivery system 306 so the mixing/delivery system 306 can deliver the bulk explosive materials into the conduit 302.

Longitudinal movement of the nozzle 310 and distal end of the delivery conduit 302 relative to the borehole 106 may be managed by the vehicle wheels, by driving forward and backwards. Once the boom head 314 is over the borehole 106 the delivery conduit 302 is dropped into the borehole 106, regardless of the inclination. The boom head 314 does not need to be angled to manage the delivery conduit 302 in the borehole 106 as the delivery conduit 302 is not rigid.

The dispense control system 308 includes modules configured to control the mixing/delivery system 306 to dispense the bulk explosive materials when the hose reel 304 has extended the delivery conduit 302 to an operational depth in the borehole 106, and control the hose reel 304 to extend and to withdraw the conduit 302. The dispense control system 308 may include a microcontroller with signal inputs/outputs and machine-readable memory storing the modules defining the operation of the dispense control system 308.

Two or more bulk explosives components may be mixed by the mixing/delivery system 306, which may deliver the resulting mixture (referred to as the "bulk explosive product"), forming at least one of the bulk explosive materials, to the delivery conduit 302.

The delivery conduit 302 may include the bulk hose and the electrical/fluidic connections of the link 204, optionally held in a protective sheath.

As shown in FIG. 6, the conduit 302 can be dispensed from the hose reel 304 and routed through the boom head 314 which is connected to the boom 312. The boom 312 can operate in at least one axis, e.g., outward from and towards a centreline of the mechanized platform/vehicle 1504. The boom 312 can be used to traverse the nozzle 310 over the borehole 106 to align with the borehole axis 402. The dispense control system 308 controls movement of the boom 312 and the boom head 314. The longitudinal positioning may be provided by driving movement of the mechanized platform/vehicle 1504.

Figure 7A:
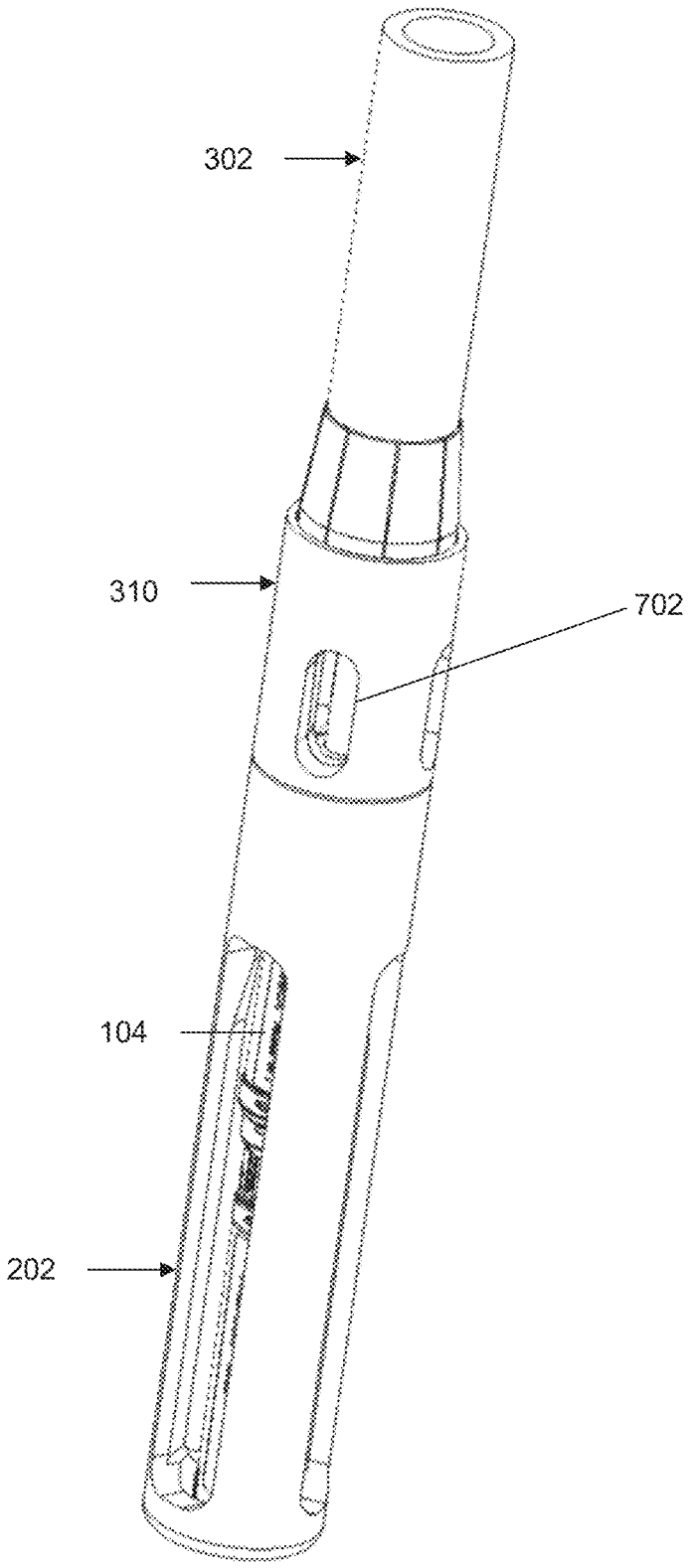
FIG. 7A is a perspective-view diagram of the deployment device on a delivery conduit of the dispense system.
Figure 7B:
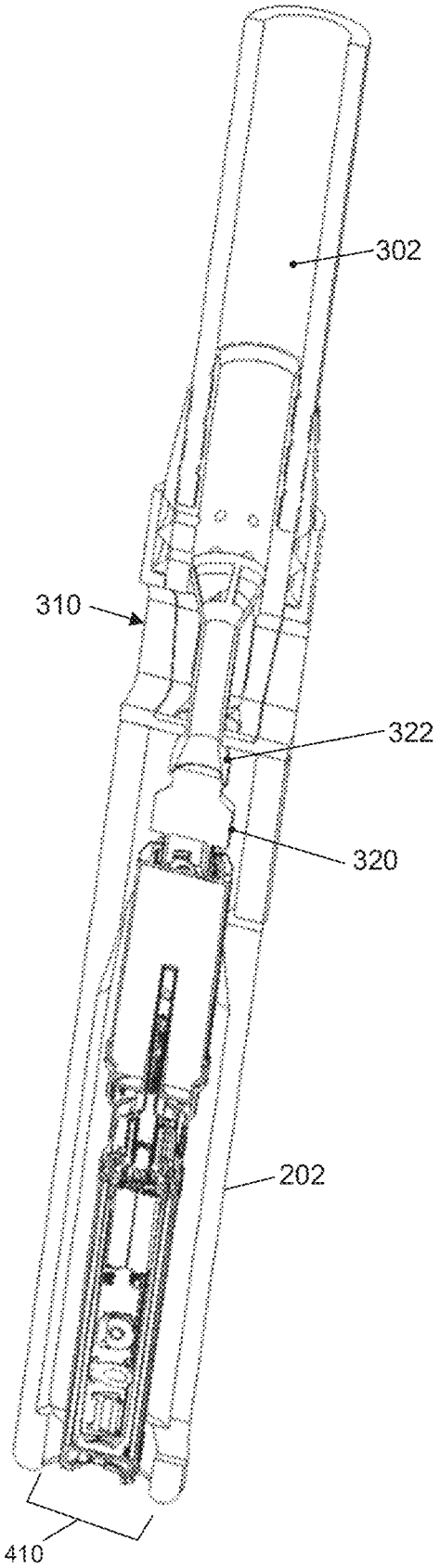
FIG. 7B is a cross-sectional diagram of the deployment device on the delivery conduit of the dispense system.

As shown in FIG. 7A and FIG. 7B, the free end portion of the delivery conduit 302 may include: the nozzle 310; and the deployment device 202. The nozzle 310 and the deployment device 202 may be co-axial, directly connected, indirectly connected, and/or formed as one device, e.g., from a steel housing. The link 204 may include the conduit 302. The extension control mechanism 206 may include the reel 304. The deploy control system 208 may be integrated with the dispense control system 308, e.g., into a shared microcontroller with machine-readable memory and signal inputs/outputs. The nozzle 310 and/or the deployment device 202 may include a fluid valve to control the flow of the bulk explosive materials to be selectably into the deployment device 202 (to eject the wireless device 104) or through nozzle holes 702 (that are not into/through the internal cavity of the deployment device 202) in order to supply the bulk explosive materials to the borehole 106 without ejecting the wireless device 104, e.g., for filling the toe 112 of the borehole 106.

The deploy control system 208 and/or the dispense control system 308 may be configured to: (i) control the reel 304 (forming the extension control mechanism 206) to extend (e.g., lower) the deployment device 202 to the predefined/selected operational location (e.g., defined in a blasting plan that is stored/accessed by the deploy control system 208 and/or the dispense control system 308) and to stop at the predefined/selected operational location (e.g., based on the predefined loading depth); (ii) control the deployment device 202 to eject/deploy the wireless device 104 by deactivating the securing arrangement and/or activating the ejection mechanism; and (iii) control the mixing/delivery system 306 and the reel 304 to load the bulk explosive materials into the borehole 106 to respective product depth(s) that are predefined/selected in the blasting plan.

The platform/vehicle 1504 may include a Mobile Manufacturing Unit (MMU) or Mobile Processing Unit (MPU), e.g., a Bulkmaster™ MMU from Orica Group™.

Depth Sensor System

The depth sensor system is configured to make depth measurements of the housing 202/link 204, and to generate the depth signals for the deploy control system 208. By using the depth signals from the depth sensor system, the deploy control system 208 may be configured to determine the depth of the deployment device 202 in the borehole 106 and depth in the fluid explosive material, and to only release the wireless device 104 when the depth of the wireless device 104 in/on the deployment device 202 in the borehole 106 and/or in the fluid explosive material is substantially equal to selected deployment depth for that wireless device 104, e.g., as selected from a blasting plan.

As described hereinbefore, the depth sensor system may include the movement sensor that is in communication with the link 204 (as it moves) and that is configured to measure movement of the link 204 such that the location inputs receive (motion) measurements representing the measured motion of the link 204. As mentioned hereinbefore, the movement sensor may include an encoder (or "movement encoder") that generates the motion measurements from movement of a wheel connected to the link 204 as the link 204 moves. The movement sensor may have an accuracy of substantially 0.5 m, or better than (i.e., less than) 0.5 m, 0.4 m, 0.3 m, 0.2 m or 0.1 m. The extension control mechanism 206 may include a level winder configured to manage the winding/drawing/extending of the link 204 such that is it repeatable. The level winder may improve accuracy of the movement sensor. The movement sensor maybe mounted/attached to the extension control mechanism 206.

The extension control mechanism 206 may include or be fitted with the movement sensor configured to measure the depth of the deployment device 202 or at least the free end portion (or "distal end" portion) of the link 204. The movement sensor includes a rotary encoder that is connected to the extension control mechanism 206 with the link 204. The rotary encoder can provide an exact angular position of the extension control mechanism 206 in degrees ("absolute encoder") or increments per 360 degrees ("incremental encoder") with each increment consisting of pulses. The rotary encoder is configured to send the position measurements from the encoder to the deploy control system 208, and the deploy control system 208 is configured to calculate the following using the rotary encoder pulses and numerical relationships stored in the deploy control system 208: (i) the depth of the deployment device 202/free end portion of the link 204 down the borehole 106, and (ii) a speed of the link 204 moving longitudinally/along the borehole 106.

Alternatively or additionally, the depth sensor system may include a force sensor system configured to measure a weight of the link 204 when it is in the borehole 106. The force sensor system may include a tension arm, e.g., fitted to the boom head 314, that is in contact with and carries/bears the link 204, and thus a portion of the weight of the link 204 when it is in the borehole 106. The force sensor system may include one or more force sensors, e.g., tension sensors and/or compression sensors, fitted to the tension arm to measure the weight of the in-hole portion of the link 204. The force sensor system may be connected to the deploy control system 208 to send these weight measurements to the deploy control system 208, which may be configured to determine a depth of the deployment device 202. The deploy control system 208 may be configured to access a correlation of the weight measurement change(s) with the depth measurements based on stored depth measurements/profiles of the density interface(s), e.g., representing an estimated borehole depth and/or water depth. The deploy control system 208 may be configured to generate an indicator/flag/alert when the weight measurement changes due to the free end portion and/or the deployment device 202/nozzle 310 reaching a density interface, e.g., an interface between air in the borehole 106 and water in the borehole 106, or an interface between air/water in the borehole 106 and the bottom/toe of the borehole 106.

Alternatively or additionally, the depth sensor system may include:

a. a sensor component (referred to as a "in-hole sensor component"); and
b. a depth component configured to automatically determine (e.g., fix/set/select or monitor/measure/sense) a relative depth R of the sensor component in the borehole 106 relative the deployment device 202.

The in-hole sensor component is arranged and configured relative to the deployment device 202 such that the in-hole sensor component is substantially at the depth of the deployment device 202 in the borehole 106, including when the deployment device 202 is in air (or an "empty" borehole) and/or in fluid (including water and/or bulk explosive materials and/or mud).

The sensor component may include a sensor array configured to automatically determine a depth B ("array depth") of the sensor array in the fluid explosive material in the borehole as described in Singapore Provisional Patent Application No. 10202113093T filed 25 Nov. 2021 in the name of Orica International Pte Ltd. If the deployment device 202 is configured to be at substantially the same depth as the nozzle 310 (when the delivery conduit 302 is in the link 204), the depth component may be configured to automatically determine the relative depth R of the sensor component relative to the nozzle 310 while the nozzle 310 is loading the fluid explosive material in the borehole 106, as described in Singapore Provisional Patent Application No. 10202113093T filed 25 Nov. 2021 in the name of Orica International Pte Ltd.

The sensor array may be arranged over and/or around the deployment device 202, and/or on the link 204 at a selected length from the deployment device 202 (e.g., slightly proximal or distal of the housing). The sensor array may be formed/located in or on an outer surface of the conduit 302 and/or of the deployment device 202

The sensor component may include a microcontroller in the housing and connected to the sensor array to convert data obtained from the sensor array and send the depth signals as data to the deploy control system 208 via the wireline cable. The data represents a depth B of the sensor array in the fluid and/or a relative depth R of the sensor array 122 in the borehole 106.

Securing Arrangement and Ejection Mechanism

The deployment device 202 includes/provides a securing arrangement configured to reversibly secure/hold the wireless device 104 while the wireless device 104 is in the deployment device 202 (including while the deployment device 202 is being lowered/extended into the borehole 106, which may include bumping into the borehole walls, and being lowered/extended into the bulk explosive materials). The hold of the securing arrangement is reversible in order to release the wireless device 104 from the deployment device 202 once it is in the predefined/selected operational location in the borehole 106. As described hereinafter, the securing arrangement operates by the deployment device 202 interacting with the wireless device 104 (optionally including its adaptor), and the features of the securing arrangement may be provided by the deployment device 202 itself and/or by the wireless device 104 (and/or by the adaptor).

The deployment device 202 may include/provide the ejection mechanism configured to eject the wireless device 104 by releasing the wireless device 104 from the securing arrangement, and by ejecting the wireless device 104 from the deployment device 202. As described hereinafter, the ejection mechanism operates by the deployment device 202 interacting with the wireless device 104 (optionally including its adaptor), and the features of the ejection mechanism may be provided by the deployment device 202 itself and/or by the wireless device 104 (and/or by the adaptor).

In use:

a. when the deployment device 202 is out of the borehole 106, the deploy system 100 attaches/secures the wireless device 104 in/to the deployment device 202 (or into the deployment device 202), and the deploy system 100 engages/operates/activates the securing arrangement to secure/hold the wireless device 104 on/in the deployment device 202 such that the wireless device 104 does not fall out of or off the deployment device 202 due to gravity or due to bumps/impacts when the deployment device 202 is moved towards and into the borehole 106; and b. when the deployment device 202 is in the borehole 106, at the predefined/selected operational location, the deploy system 100 simultaneously disengages/operates/deactivates/releases the securing arrangement and activates/operates/engages the ejection mechanism to release/eject the wireless device 104 from the deployment device 202.

The securing arrangement and the ejection mechanism are operated by the deploy system 100 together and in concert to securely/safely hold the wireless device 104, to carry the wireless device 104 into the borehole 106 to its predefined/selected operational location, and to place the wireless device 104 at its predefined/selected operational location.

The securing arrangement applies at least one retaining force on/to the wireless device 104 to hold the wireless device 104 in/to the deployment device 202 to at least overcome natural ejection forces due to gravity and/or the bumps/impacts. The securing arrangement may be configured to apply the retaining force at a level/strength that is less that what can be manually applied by a person (adult): this may allow the wireless device 104 to be removed manually from the deployment device 202 if there is an error/interruption, e.g., during the programming by the encoder as described hereinafter.

The ejection mechanism may apply at least one ejection force on/to the wireless device 104 to eject the wireless device 104 from the deployment device 202. If there is no ejection mechanism, the wireless device 104 may be ejected from the deployment device 202 by the natural ejection forces due to gravity and/or the bumps/impacts and/or viscosity of the bulk explosive materials holding the wireless device 104 (once the wireless device 104 is immersed in the bulk explosive materials) when the retaining force is removed by deploy system 100 disengaging/deactivating/releasing the securing arrangement.

Active and Passive Securing Arrangements and Ejection Mechanisms

The securing arrangement may include a passive securing arrangement that does not require an activation signal or energy/power from the deploy system 100 to continue applying the retaining force while the wireless device 104 is in/on the deployment device 202—the passive securing arrangement may be referred to as applying the securing force "naturally". The passive securing arrangement may include: a securing spring arrangement that mechanically applies the retaining force; and/or a permanent magnet that magnetically applies the securing force. The securing spring arrangement (also referred to as a "gripper" or "wireless device gripper") has a natural resilience that holds the wireless device 104 in place in/on the deployment device 202 by applying the retaining force. The permanent magnet has a natural magnetic field that hold the wireless device 104, which includes a magnetic/ferromagnetic portion, in place in/on the deployment device 202 by applying the retaining force.

The securing arrangement may include an active securing arrangement that uses energy/power to apply the retaining force and requires a retaining activation signal from the deploy system 100 to the deployment device 202 in order to engage/operate/activate. The active securing arrangement also requires a retaining deactivation signal (generally from the deploy system 100 to the deployment device 202)—which can be in the form of cessation of the retaining activation signal, in order to disengage/de-activate/cease operation. The active securing arrangement may include: an electromagnet that applies the retaining force via a magnet field that holds a ferromagnetic material (e.g., ferrite plate or permanent magnet) of the wireless device 104 (optionally of its adaptor); and/or a fluid inlet/port/mouth/outlet that applies the retaining force via a selected fluid pressure that holds the wireless device 104 optionally by its adaptor (by positive pressure clamping the wireless device 104, in which case the fluid inlet/port/mouth/outlet may be referred to as a "gripper port"; or by negative pressure gripping the wireless device 104, in which case the fluid inlet/port/mouth/outlet may be referred to as a "suction inlet"). The fluid inlet/port/mouth/outlet may be described as forming a "pressure actuated couple". The fluid ("securing fluid") may be water, air, the one or more bulk explosive materials, and/or an explosive component. The power/energy for the active securing arrangement is provided by a power/energy source (of the deploy system 100 for the securing arrangement) that may include at least one pressure source (e.g., pump or positive/negative pressure vessel) fluidly connected to the fluid inlet/port/mouth/outlet and arranged to provide the selectable fluid pressure at the fluid inlet/port/mouth/outlet (e.g., sufficient to provide the example retaining forces described hereinafter) or at least one electrical energy source electrically connected to the electromagnet and arranged to provide electrical power to the electromagnet (e.g., the electrical power source of the mechanized platform/vehicle 1504). The deploy control system 208 may be configured to send the retaining activation signal (and the retaining deactivation signal thereafter) to a controller module (referred to as a "pressure/magnet controller module") of the at least one pressure source or of the at least one electrical energy source to control the fluid inlet/port/mouth/outlet or the electromagnet to generate and apply the retaining force (and to stop applying the retaining force following the retaining deactivation signal). The deploy system 100 may include an electronic link (which may be a wired link, e.g., an analog or digital connection along the wireline cable in the link 204) formed to carry the retaining activation signal (and the retaining deactivation signal thereafter) from the deploy control system 208 to the pressure/magnet controller module. The electronic link communicatively connects the deploy control system 208 to the controller module of the electromagnet, and the controller module of the electromagnet is configured to activate and deactivate the electromagnet via a wireline cable, including to apply the retaining force, no force (off)—and optionally the ejection force described hereinafter. The deploy system 100 may include a pressure/fluidic link including the pressure hose/channel in the link 204 from the pressure source to the fluid inlet/port/mouth/outlet: when the securing fluid is substantially air, the pressure hose/channel and the fluid inlet/port/mouth/outlet may be referred to as forming a "pneumatic system", and when the securing fluid is substantially water/oil, the pressure hose/channel and the pressure port may be referred to as forming a "hydraulic system". In an example, the suction inlet applies negative pressure until the retaining deactivation signal is received, after which the negative pressure at the suction inlet is reduced until the negative pressure is insufficient to resist the natural forces and/or the ejection force of the passive ejection mechanism urging/forcing the wireless device 104 from the deployment device 202.

The ejection mechanism may include a passive ejection mechanism or an active ejection mechanism. In general, one or both of the securing arrangement and the ejection mechanism are active so that one or the other (or both) can be activated by the release signal from the deploy system 100 to the deployment device 202 when the deploy system 100 determines that the wireless device 104, carried by the deployment device 202, has reached the predefined/selected operational location or is sufficiently close to the operational location to be ejected.

The passive ejection mechanism may include an ejecting spring arrangement that is naturally at rest with low stored potential energy in the deployment device 202 until the deploy system 100 attaches/secures the wireless device 104 in/to the deployment device 202 wherein the deploy system 100 forces the wireless device 104 (optionally including its adaptor) into/onto the passive ejection mechanism, thus increasing the stored potential energy of the ejecting spring arrangement (which may be referred to as "spring loading") in order to apply the ejection force ("passive ejection force"), while simultaneously activating the active securing arrangement to apply the retaining force ("active retaining force") such that the active retaining force is greater than the passive ejection force, and such that the active retaining force is sufficiently greater than the passive ejection force to additionally overcome the natural ejection forces due to gravity and/or the bumps/impacts. The ejecting spring arrangement may include a spring that is compressed into compression by the wireless device 104 (optionally by its adaptor) being forced into/onto the passive ejection mechanism. Due to natural resilience of the ejecting spring arrangement, the passive ejecting arrangement does not require applied/activated energy/power from the deploy system 100 to continue release/eject the wireless device 104 from the deployment device 202. Using the passive ejection mechanism with the active securing arrangement may allow the securing mechanism itself to force/pull the wireless device 104 (optionally by its adaptor) into/onto the passive ejection mechanism (thus spring-loading the passive ejection mechanism) without requiring a separate mechanisms to load the wireless device 104 into/onto the deployment device 202, and without requiring a separate energy supply for the ejection mechanism. In other words, the passive ejection mechanism (also referred to as a "passive ejector") can be held in compression by the wireless device 104 in the deployment device 202, storing potential energy, ready to be released when the securing arrangement is released.

The active ejection mechanism uses energy/power from a power/energy source to apply the ejection force and requires an ejection activation signal from the deploy system 100 to the deployment device 202 in order to activate/operate/engage. The active ejection mechanism may include: an electromagnet that applies the ejection force via a magnet field that forces the wireless device 104 (optionally via its adaptor) against the retaining force and overcomes the retaining force; and/or a fluid inlet/port/mouth/outlet (which may be referred to as an "ejection outlet") that applies the ejection force via a selected fluid pressure that ejects/releases the wireless device 104 optionally via its adaptor (by negative pressure releasing the securing arrangement, or positive pressure overcoming the securing arrangement). As with the active securing arrangement, the fluid ("ejection fluid") may be water, air, the bulk explosive materials, and/or an explosive component. Using the active ejection mechanism with the passive securing arrangement may allow the wireless device 104 to be safely kept/retained in/on the deployment device 202, even if/when the deployment device 202 loses its source of supplied energy/power: for example, if a power connection to the deployment device 202 is lost, e.g., due to the link 204 being damaged or damage to an internal power source in the deployment device 202, while the deployment device 202 is in the borehole 106, having the passive securing arrangement would mitigate the risk of the wireless device 104 falling from the deployment device 202 at an unplanned depth/location, which may be problematic for explosive initiation devices/primers. The power/energy for the active ejection arrangement may be provided by a power/energy source (of the deploy system 100 for the ejection mechanism) that may include: at least one pressure source (e.g., pump or positive/negative pressure vessel) fluidly connected to the fluid inlet/port/mouth/outlet and arranged to provide the selectable fluid pressure at the fluid inlet/port/mouth/outlet (e.g., sufficient to provide the example ejection forces described hereinafter) or at least one electrical energy source electrically connected to the electromagnet and arranged to provide electrical power to the electromagnet (e.g., the electrical power source of the mechanized platform/vehicle 1504). The deploy control system 208 may be configured to send the ejection activation signal to a controller module of the at least one pressure source or of the at least one electrical energy source to control the fluid inlet/port/mouth/outlet or the electromagnet to generate and apply the ejection force. The deploy system 100 may include an electronic link (which may be a wired link, e.g., an analog or digital connection along the wireline cable in the link 204) formed to carry the ejection activation signal from the deploy control system 208 to the pressure/magnet controller module. The electronic link communicatively connects the deploy control system 208 to the controller module of the electromagnet, and the controller module of the electromagnet is configured to activate and deactivate the electromagnet via a conductive cable/wire, including to apply the ejection force, no force (off)—and optionally the retaining force described hereinbefore. The deploy system 100 may include a fluidic link including the pressure hose/channel in the link 204 from the pressure source to the fluid inlet/port/mouth/outlet: when the ejection fluid is substantially air, the hose/channel and the fluid inlet/port/mouth/outlet may be referred to as forming a "pneumatic system", and when the ejection fluid is substantially water/oil, the hose/channel and the pressure port may be referred to as forming a "hydraulic system". The power/energy source, the pressure/magnet controller module, the electronic link, the conductive cable/wire, and/or the fluidic link for the ejection mechanism may be provided by, or be separate from, the corresponding power/energy source, the pressure/magnet controller module, the electronic link, the conductive cable/wire, and/or the fluidic link for the securing mechanism. In an example, when the ejection activation signal is received, the pressure source applies pressure to the fluid in the pipe/channel in order to generate positive pressure at the ejection outlet, thus generating the ejection force.

The hydraulic system may include the ejection outlet provided/powered by the delivery conduit 302, and the pressure source may include the one or more pumps of the mixing/delivery system 306, and the ejection force at the ejection outlet may be applied by one of the bulk explosive materials. In other words, the bulk explosive material(s) used to load the borehole 106 may also be used to provide the pressure/force to eject the wireless device 104 from the deployment device 202. The deploy control system 208 may send a command/signal to the product mixing/delivery system 306 to convey the bulk material (flow) along the delivery conduit 302 (forming the link 204) to the ejection outlet, which creates the increased pressure, creating thrust to eject the wireless device 104 from the deployment device 202. The suction inlet may also be provided/powered by the delivery conduit 302 such that the one or more pumps of the mixing/delivery system 306 provide the negative pressure of the active fluidic securing arrangement.

To summarise, the securing arrangement may be passive (i.e., applying the securing force without power/energy from a power/energy source) or active (i.e., applying the securing force with power/energy from a power/energy source), and the ejection mechanism may be passive or active, and in general one or both of the securing arrangement and the ejection mechanism are active (relying on the respective activation signals to apply their respective forces).

Side-Applied and End-Applied Retaining Forces and Ejection Forces

The retaining force and the ejection force may be applied to an intermediate portion of the wireless device 104: in this case, they are described as side-applied forces. The retaining force and the ejection force may be applied to one or more end portions of the wireless device 104, in which case they are described as end-applied forces.

The deployment device 202 may be configured to apply combinations of the end-applied forces and the side-applied forces, including: a side-applied retaining force with a side-applied ejection force; the side-applied retaining force with an end-applied ejection force; an end-applied retaining force with the side-applied ejection force; and the end-applied retaining force with the end-applied ejection force. Examples are described hereinafter.

Wireless Device Adaptor

The wireless device 104 may include at least one adaptor (also referred to as a "deployment adaptor" or "wireless device adaptor") that are connected to the wireless device 104 to adapt the wireless device 104 to engage with the securing arrangement and/or the ejection mechanism. Using the adaptor may allow a pre-existing wireless device 104 to be configured for use with the deploy system 100 without needing to reengineer/reconfigure/rebuild the wireless device 104. For example, the securing mechanism may be configured to hold/secure wireless device 104 by holding its adaptor (which is itself secured to the rest of the wireless device 104). The adaptor is connected to a body of the wireless device 104 (where "body" refers a body, housing or frame of the wireless device 104 without the adaptor) with a connection force that is greater than the retaining force and/or the ejection force such that the adaptor remains connected to the wireless device 104 during the loading and the ejection/release of the wireless device 104. With the adaptor, the retaining force, and the ejection force (as relevant), are applied to the adaptor of the wireless device 104 instead of, or in addition to, being applied to the body of the wireless device 104.

The adaptor may be connected to the wireless device body by a mechanical connection.

The at least one adaptor may include an end adaptor that is configured to connect/couple to a longitudinal end portion of the wireless device 104 (e.g., at cylindrical ends for a more cylindrical wireless device body, or at polar ends for a more spherical wireless device body), and/or an intermediate adaptor that is configured to connect/couple to the wireless device 104 between its ends and to/around an intermediate portion of the wireless device body (e.g., to/around a cylindrical middle for a more cylindrical wireless device body, or to/around a equatorial circumference for a more spherical wireless device body).

The intermediate adaptor may be in the form of an intermediate coupler with an intermediate coupling portion configured to mate with at least one cooperative intermediate portion of the wireless device 104. The intermediate coupler portion and the cooperative intermediate portion may fit together using a screw fitting (with cooperative screw threads formed in the intermediate coupler portion and the cooperative intermediate portion), or a snap fitting (with a projection/plug from one of the intermediate coupler portion and the cooperative intermediate portion fitting tightly into an aperture/opening/socket the intermediate coupler portion and the cooperative intermediate portion, due to natural resilience of the intermediate coupler portion and/or the cooperative intermediate portion), and/or one or more fasteners (e.g., screws, pins and/or adhesives), and/or a belt configured to fit around and tighten onto the cylindrical middle (for a more cylindrical wireless device body) or the equatorial circumference (for a more spherical wireless device body).

Figure 8A:
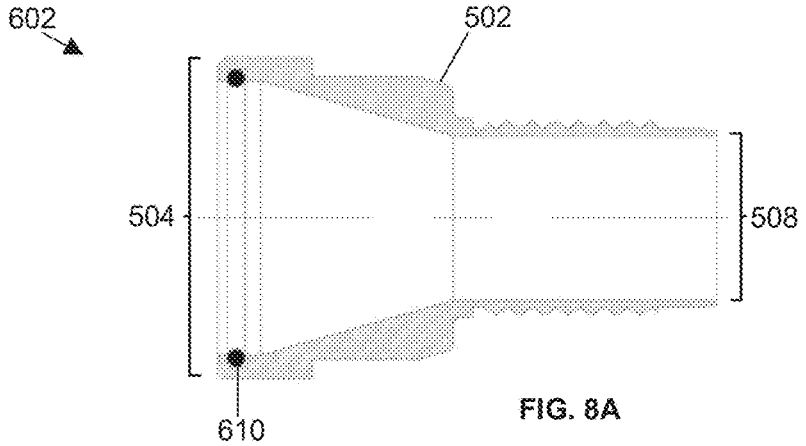
FIG. 8A is a cross-sectional side-view diagram of an end adaptor for/of a wireless device.

In at least one example, as shown in FIG. 8A, the end adaptor may include: a body 502 ("adaptor body") forming secure mechanical unit, e.g., formed of one or more moulded plastic pieces; a wireless-device end 504 configured to connect/couple to the longitudinal end portion of the wireless device 104 (optionally including a resilient coupling element configured/arranged to provide friction/force to connect/couple to the longitudinal end portion, e.g., an O-ring 610; and a deploy-housing end 508 configured to connect/couple to the securing arrangement of the deployment device 202, wherein the deploy-housing end 508 may be at an opposite longitudinal end of the adaptor body 502 from the wireless-device end 504.

Figure 8B:
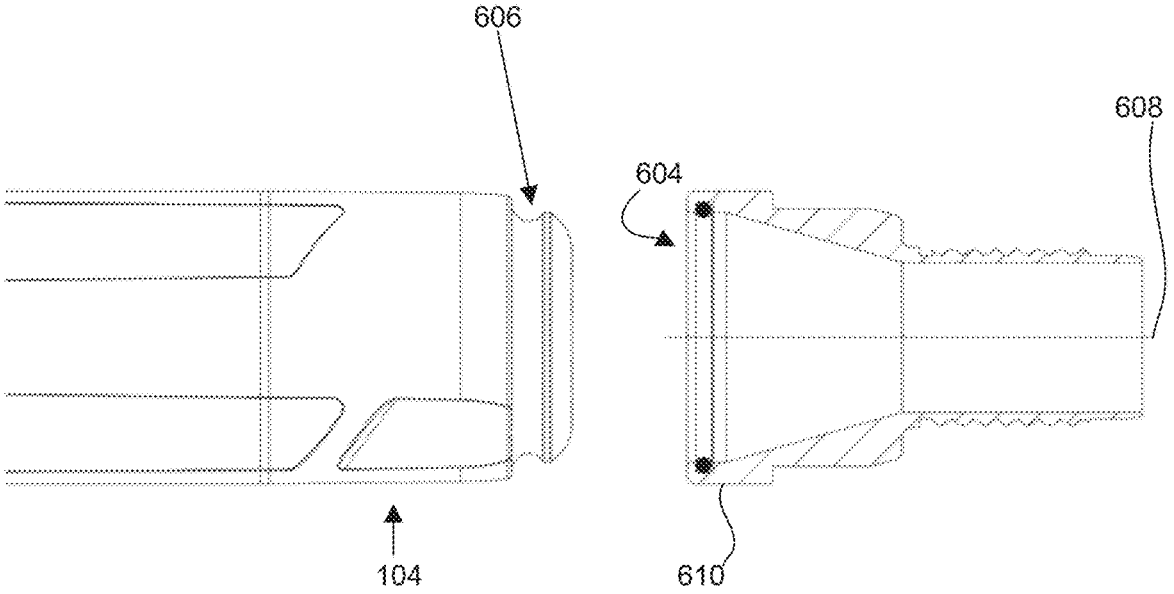
FIG. 8B is a side-view diagram of a portion of the wireless device, and the end adaptor (shown in cross section) aligned for attachment to the wireless device.
Figure 8C:
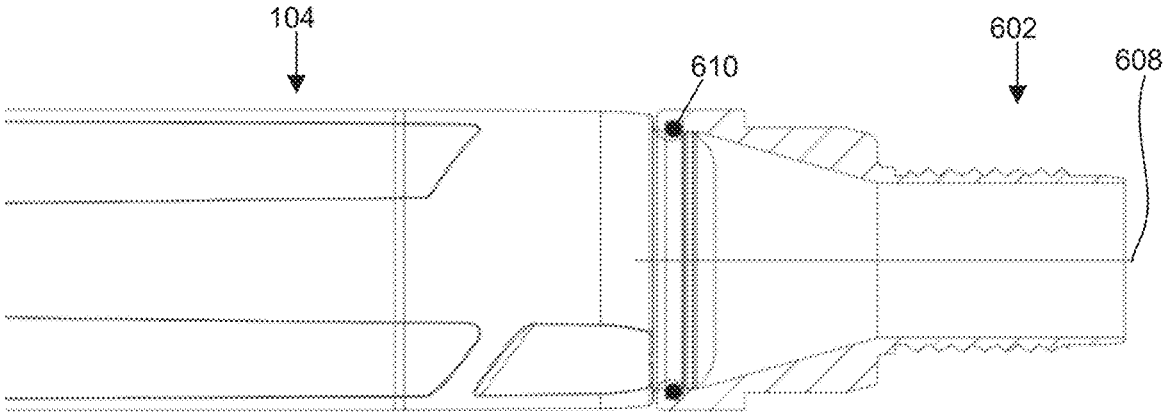
FIG. 8C is a side-view diagram of the portion of the wireless device, and the end adaptor (shown in cross section) attached to the wireless device.

In at least one example, as shown in FIG. 8B and FIG. 8C, an example end adaptor 602 may include a mouth/opening 604 configured to fight engagingly onto/over a projection 606 (also referred to as a lip on the end) of the wireless device 104. In alternative examples, the end adaptor may include projection configured to fight engagingly into a mouth/opening of the wireless device 104. The projection 606 may be at the longitudinal end portion of the wireless device 104, as shown in FIG. 8B. The wireless device 104 and the example end adaptor 602 may connect/couple along a longitudinal axis 608 of both the wireless device 104 and the example end adaptor 602, as shown in FIG. 8B and FIG. 8C. The mouth/opening 604 may include a resilient coupling element configured/arranged to provide friction/force to connect/couple to the longitudinal end portion, e.g., the O-ring 610. The projection 606, e.g., as shown in FIG. 8B, or the mouth/opening of the wireless device 104, may be may be formed in the casing/housing/body of the wireless device 104, e.g., by moulding.

Figure 8D:
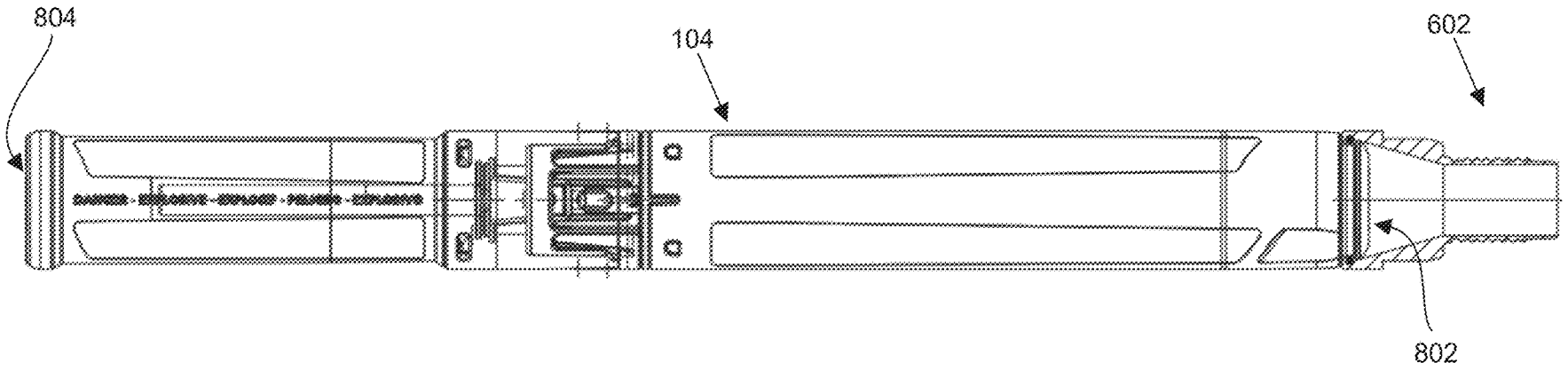
FIG. 8D is a side-view diagram of the wireless device, and the end adaptor (shown in cross section) attached to the deployment device.

As shown in FIG. 8D, the wireless device 104 configured for the end adaptor may include a plurality of longitudinal end portions 802,804 configured to cooperate with the end adaptor, e.g., the example end adaptor 602, such that the end adaptor can be connected/coupled to the wireless device 104 at either longitudinal end, which may allow the wireless device 104 to be mounted into the deployment device 202 (and thus eventually into the borehole 106) with a selected end directed to the toe 112. The adaptor may be connectable/couplable manually or automatically, and the longitudinal end for the adaptor may be selected depending on the blasting plan and/or the type of wireless device.

Figure 9A:
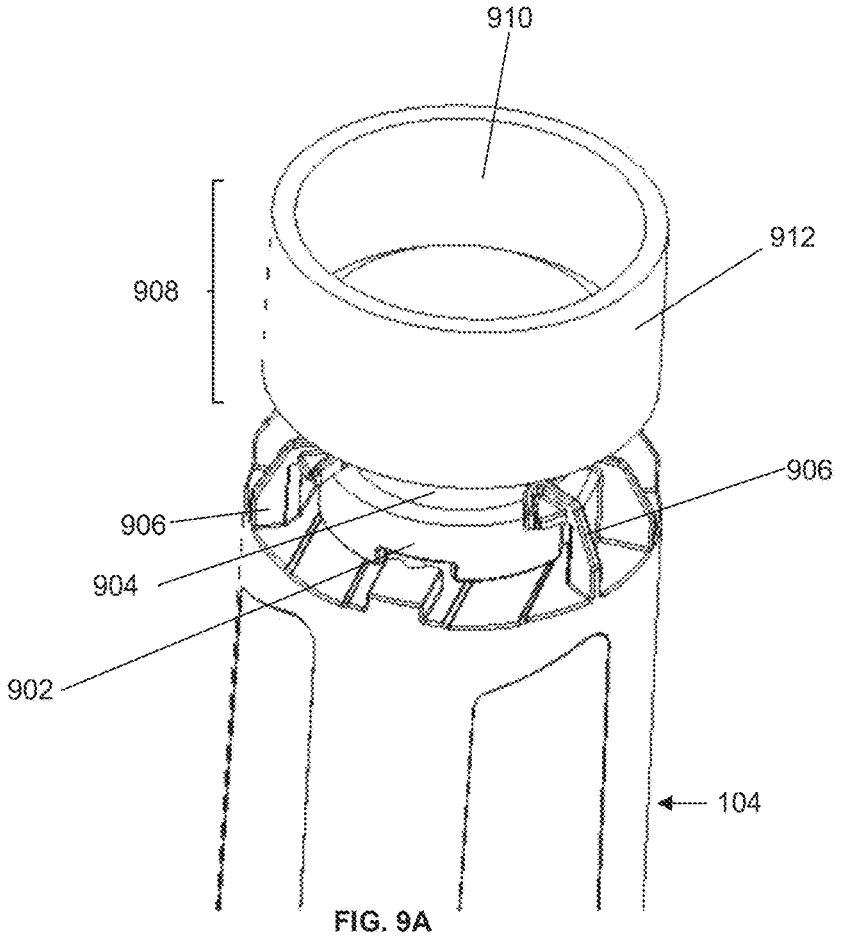
FIG. 9A is a perspective-view diagram of a portion of an example wireless device, and an example end adaptor attached to the wireless device.
Figure 9B:
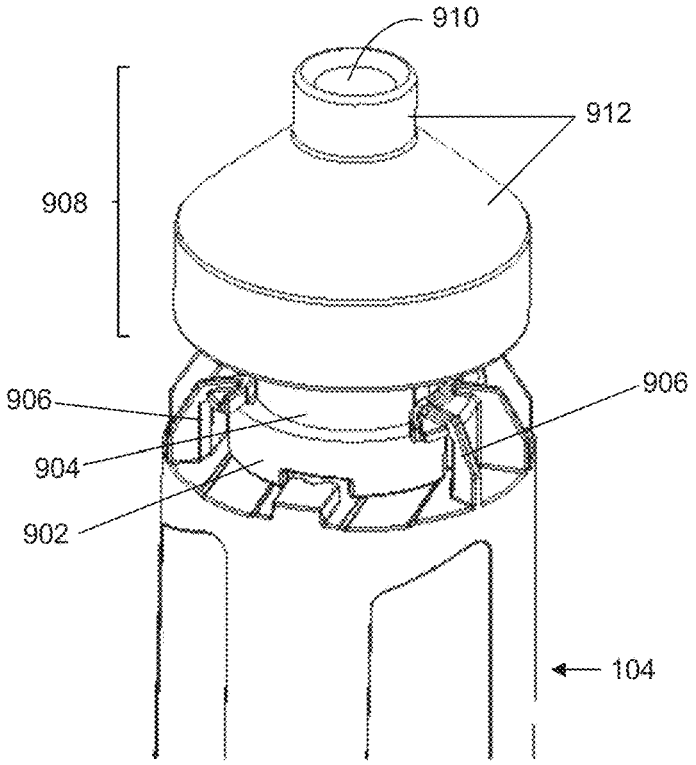
FIG. 9B is a perspective-view diagram of a portion of an example wireless device, and another example end adaptor attached to the wireless device.

In at least one example, as shown in FIG. 9A and FIG. 9B, the end adaptor may include an example projection with a flared longitudinal end (including head portion 902 with a larger diameter closer to the end than a neck portion 904 with a smaller diameter further from the end) that "snap" fits into one or more resilient retaining lugs 906 of the wireless device 104, wherein the lugs 906 bend outward to receive the head portion 902 when the end adaptor is forced into the wireless device 104, and then to "snap" into the neck portion 904 when the head portion 902 has been forced sufficiently into the lugs 906. In other examples, the wireless device 104 may include the flared longitudinal end and the end adaptor may include the lugs 906. In other examples, the adaptor may be configured to be rotated coaxially relative to the rest of the wireless device 104 to lock the head portion 902 under the lugs 906.

Figure 10A:
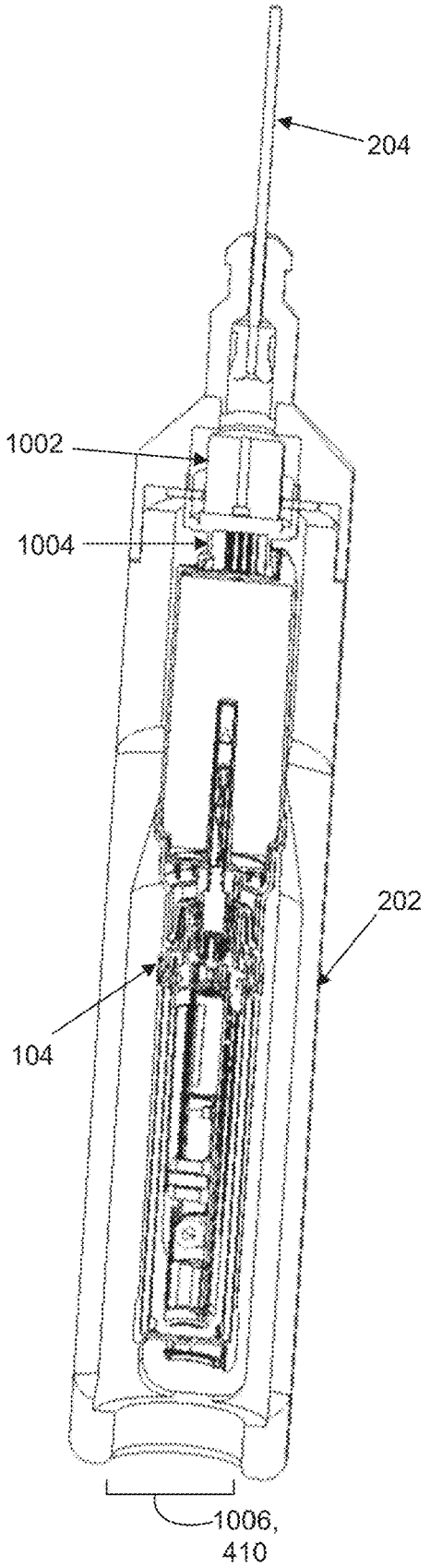
FIG. 10A is a cross-sectional diagram of the deployment device with a magnet/electromagnet at an interior longitudinal end thereof, and a wireless device in the deployment device.
Figure 10B:
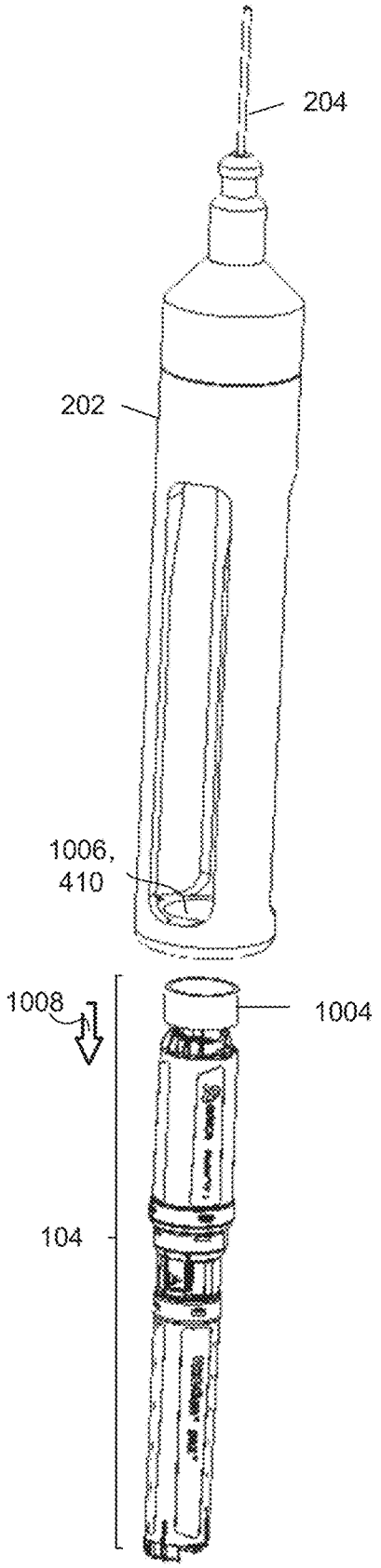
FIG. 10B is a perspective side-view diagram of the wireless device being ejected from the deployment device of FIG. 10A through an end opening of the deployment device.
Figure 10D:
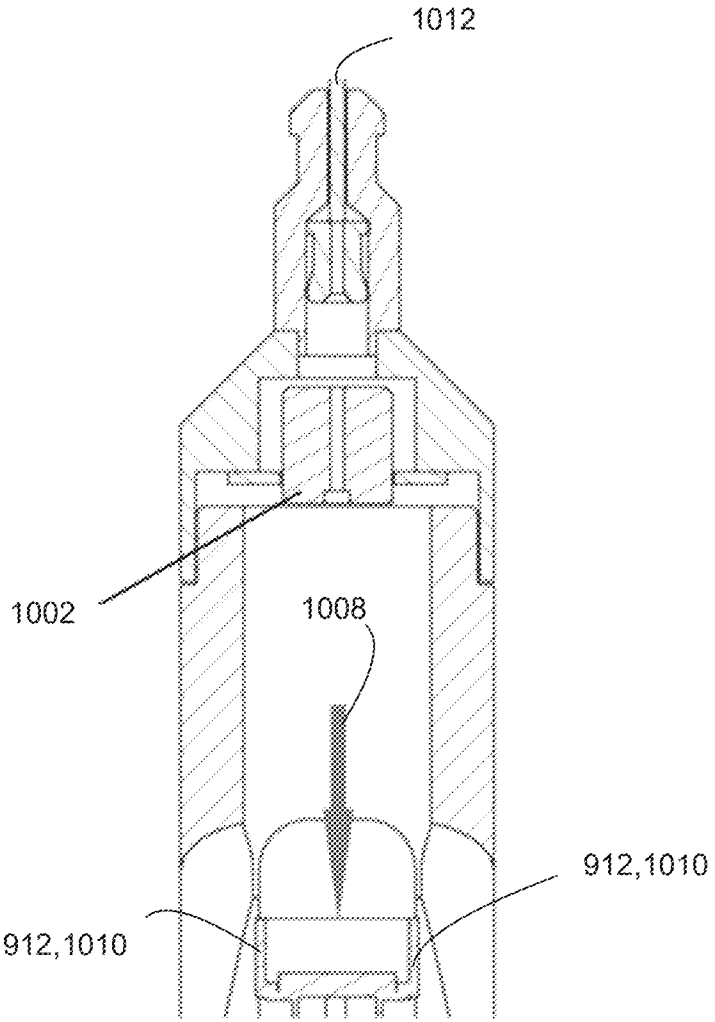
FIG. 10D is a cross-sectional side-view diagram of the portion of the deployment device with the magnet/electromagnet, showing the wireless device being ejected from the deployment device.
Figure 10C:
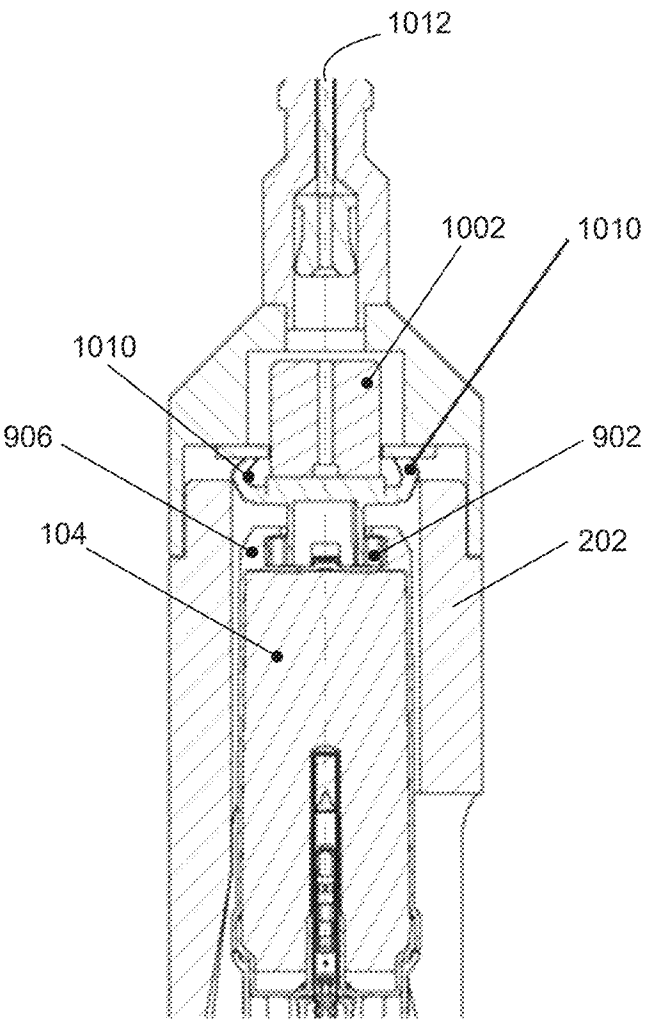
FIG. 10C is a cross-sectional side-view diagram of a portion of the deployment device of FIG. 10A, and a portion of the wireless device in the deployment device.

In at least one example, as shown in FIG. 9A and FIG. 9B, the end adaptor may include an outward facing portion 908 that includes: an outward facing opening 910, configured/positioned to face substantially away from the wireless device 104 when coupled/connected thereto, and to face substantially towards the deployment device 202 when secured therein. The outward facing opening 910 may include a fluid-resistant connection between walls 912 in the outward facing portion 908 (apart from the outward facing opening 910)—thus forming an outward facing "cup", which may provide a receiving cup for fluid pushing on the wireless device 104 from the ejection outlet. The walls 912 may be resilient (e.g., including elastic materials, e.g., an elastic polymer or rubber, nitrile rubber, nylon, plastic, and/or metal), and configured to be compressed or extended when secured in the deployment device 202 in order to provide:

a. when compressed, at least some of the ejecting spring arrangement, e.g., as described hereinafter with reference to FIG. 10C;

b. when extended, at least some of the securing spring arrangement ("gripper") of the passive securing arrangement, e.g., as described hereinafter with reference to FIG. 12A and FIG. 12B; and/or c. in conjunction with the fluid-resistant connection between the walls 912 in the outward facing portion 908 (apart from the outward facing opening 910), a fluid-resistant seal between the wireless device 104 and the deployment device 202, when the wireless device 104 is secured in/by the deployment device 202, to support the negative pressure created by the suction inlet.

Securing Spring Arrangement (or "Gripper")

The securing spring arrangement (or "gripper") may be formed/mounted within the deployment device 202; or the deployment device 202 may form the securing spring arrangement by its natural resilience. The securing spring arrangement secures the wireless device 104 in the deployment device 202 by its natural resilience and/or configuration and/or materials, i.e., without requiring a source of energy/power or electronic control. The securing spring arrangement may form a mechanical grip arrangement (or "clamp") into which the wireless device 104 is forced on loading. The grip arrangement holds the wireless device 104 by applying a grip force to the wireless device 104. The internal cavity may include a spring mechanism, including a steel spring and/or a naturally resilient material that compresses when the wireless device 104 is forced into the deployment device 202, and that (when compressed) applies the pushing force and the opposed force to the wireless device 104; alternatively, the body of the housing 202 may include a substantially resilient material, fitting tightly around the wireless device 104 when the wireless device 104 is inserted into the housing 202—the body of the housing 202 may be provided/formed by a portion of the delivery conduit 302 (e.g., the hose/pipe/tube) of the dispenser system, e.g., at or in the distal end of the delivery conduit 302. The wireless device 104 is be forced from the securing spring arrangement by the active ejection mechanism that applies the ejection force to overcome securing force (also referred to as "grip force" in this arrangement) to release the wireless device 104.

The grip arrangement may include a tight band into which the end adaptor fits with an interference fit. The grip arrangement may include an internal cavity in the deployment device 202 that is shaped to tightly fit (e.g., wrap around and/or project into) and hold the wireless device 104 (optionally with the adaptor) in the deployment device 202 along at least one axis by a securing force to hold the wireless device 104 in the deployment device 202 against forces of gravity and/or vibration/bumps as the deployment device 202 is lowered into the borehole 106. The internal cavity can include one or more projections or cavities onto/into which the wireless device 104 (optionally with the adaptor) is inserted with a push fit relying on friction to hold the wireless device 104.

Implementations of the Securing Arrangement and the Ejection Mechanism

In one or more implementations, the securing force may be substantially 20 Newtons (N) to 50 N (e.g., 30 N), and the ejection force (applied directly opposed to the securing force, and substantially greater than the securing force) may be substantially 30 N to 100 N (e.g., 40 to 50 N).

Figure 13A:
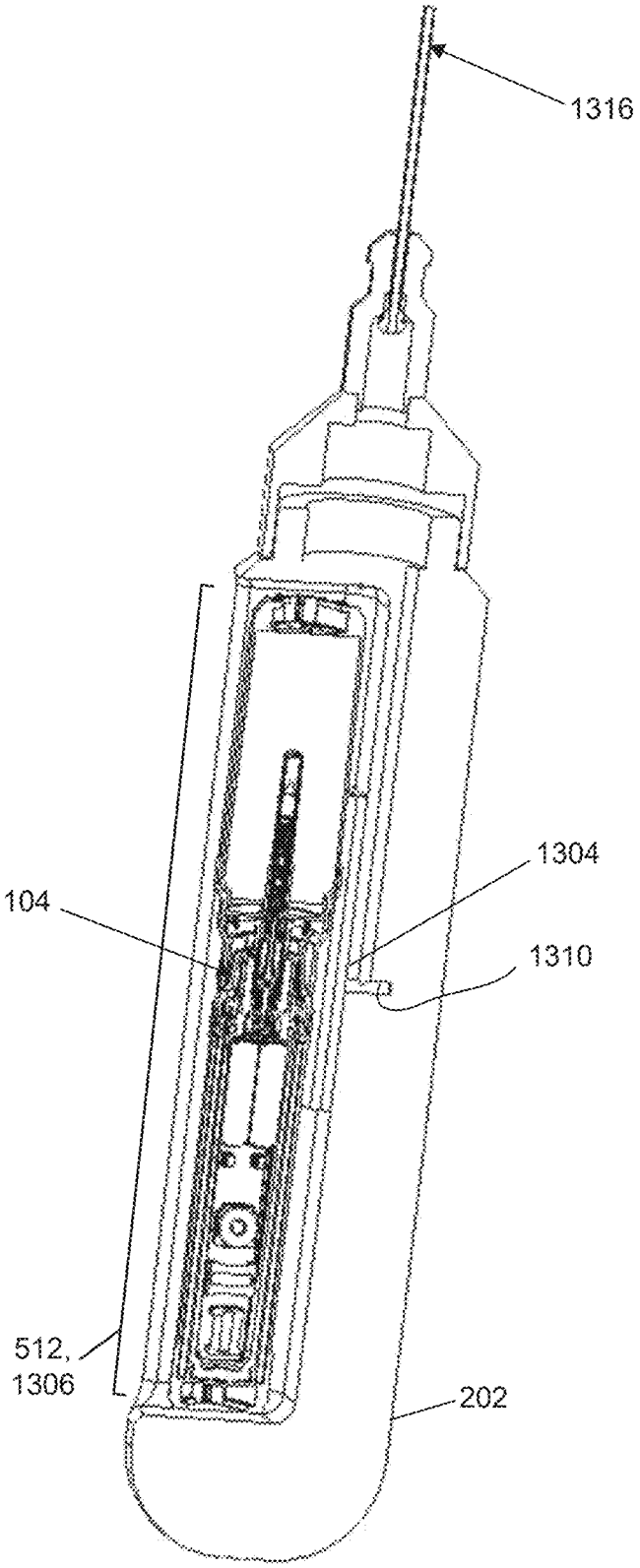
FIG. 13A is a cross-sectional side-view diagram of the deployment device with a fluid opening (for an ejection fluid) and a bladder at an interior side thereof and a side opening at an opposed interior side thereof, and a wireless device in the deployment device.
Figure 13B:
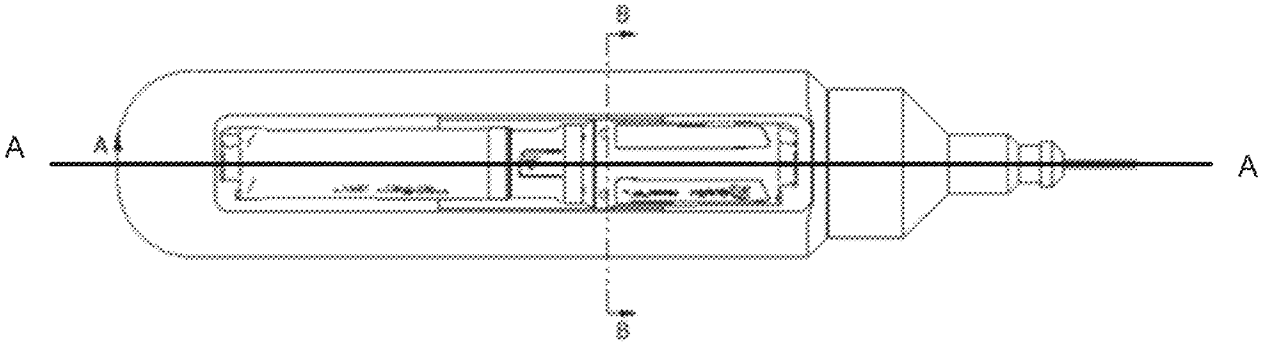
FIG. 13B is a front-view diagram of the deployment device of FIG. 13A facing the side opening showing the wireless device therein.
Figure 13C:
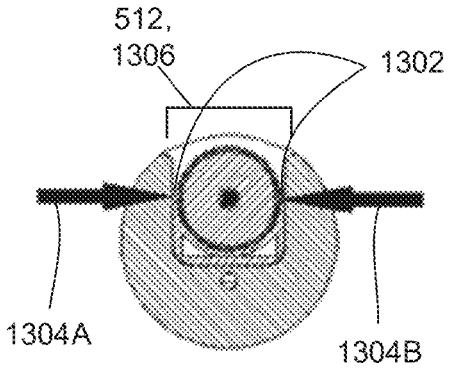
FIG. 13C is an end-view cross-sectional diagram along the line B-B in FIG. 13B.

As described with reference to FIG. 13C, the securing force may include a pushing force 1304A and an opposed force 1304B along an axis through the central axis of the wireless device 104.

As described with reference to FIG. 10A and FIG. 10C, the securing force may include a pulling force between the deployment device 202 and the wireless device 104 using a magnet/electromagnet and a cooperative ferromagnetic element/magnet.

As described with reference to FIG. 12B, the securing force may include a pulling force between the deployment device 202 and the wireless device 104 using a seal 1206 and a fluid opening 1202 which is configured to apply negative fluid pressure to the seal 1206.

In at least one example, as shown in FIG. 10A, FIG. 10B, FIG. 10C and FIG. 10D:

a. the securing arrangement may include an example electromagnet 1002 arranged in the internal cavity of the deployment device 202, and at a longitudinal end of the internal cavity to apply the retaining force to the end of the wireless device 104 (optionally including an example end adaptor 1004) which includes an example ferromagnetic material (e.g., ferrite plate or permanent magnet);

b. the internal cavity can include the end opening formed as a substantially circular hole 1006 through which the wireless device 104 is released/ejected in a longitudinal direction 1008 (substantially along the longitudinal axis of the deployment device 202) away from the example electromagnet 1002;

c. the ejecting spring arrangement may include one or more resilient walls 1010 that are compressed/squashed by insertion of the wireless device 104 into the deployment device 202, thus creating potential energy in the resilient walls 1010 while the wireless device 104 is held by the example electromagnet 1002, and then applying the end-applied ejection force when the electromagnet 1002 releases the wireless device 104, and the ejection force of the resilient walls 1010 may be substantially 40 to 50 N in the longitudinal direction 1008—the resilient walls 1010 may be provided by the walls 912 of the example end adaptor shown in FIG. 9A of the wireless device 104; and d. the link 204 may include an example wireline cable 1012 electrically connected to the electromagnet 1002 to provide electrical power to electromagnet 1002 to apply the retaining force (and optionally a portion of the ejection force), thus the example wireline cable 1012 can provide the retaining activation signal (by powering the example electromagnet 1002 to attract the wireless device 104), and can provide the retaining deactivation signal (by depowering the example electromagnet 1002), and optionally can provide the ejection activation signal (by powering the example electromagnet 1002 to generate a magnetic field of opposite polarity to the attracting electric field if the wireless device 104 includes a polarised permanent magnet configured to provide the retaining force and the ejecting force).

Figure 11A:
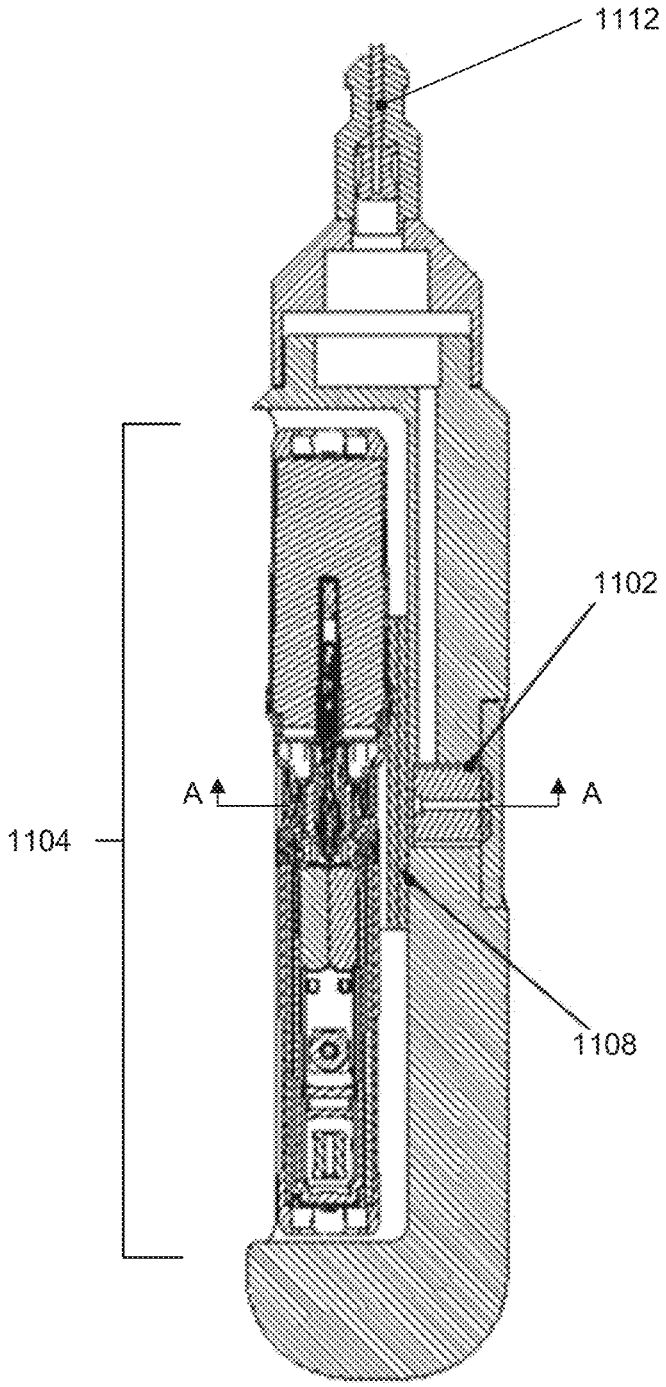
FIG. 11A is a cross-sectional side-view diagram of the deployment device with a magnet/electromagnet in an interior longitudinal side thereof and a side opening at an opposed interior side thereof, and a wireless device in the deployment device.
Figure 11B:
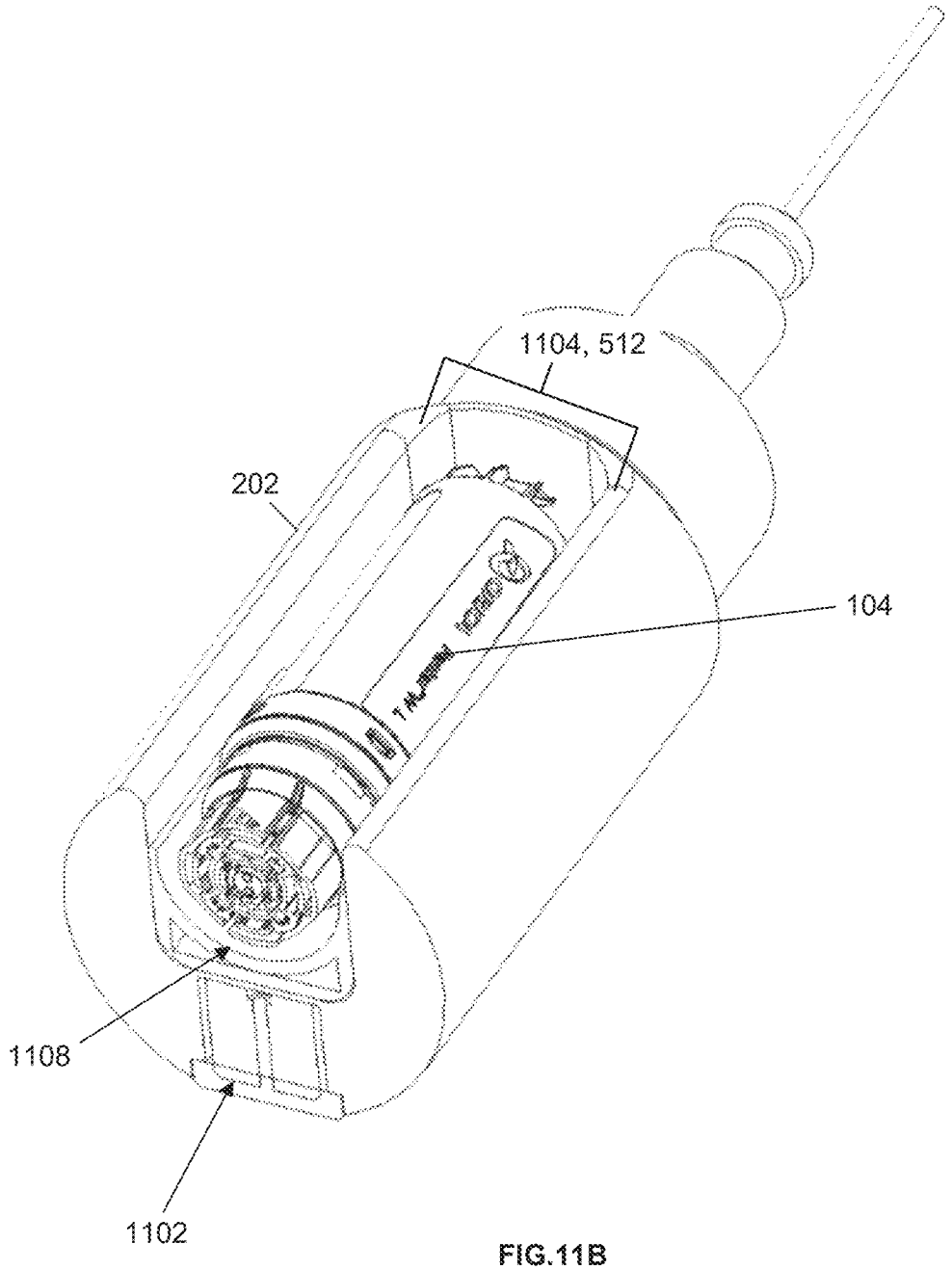
FIG. 11B is a cross-sectional perspective end-view diagram of a portion of the deployment device and the wireless device therein of FIG. 11A.
Figure 11C:
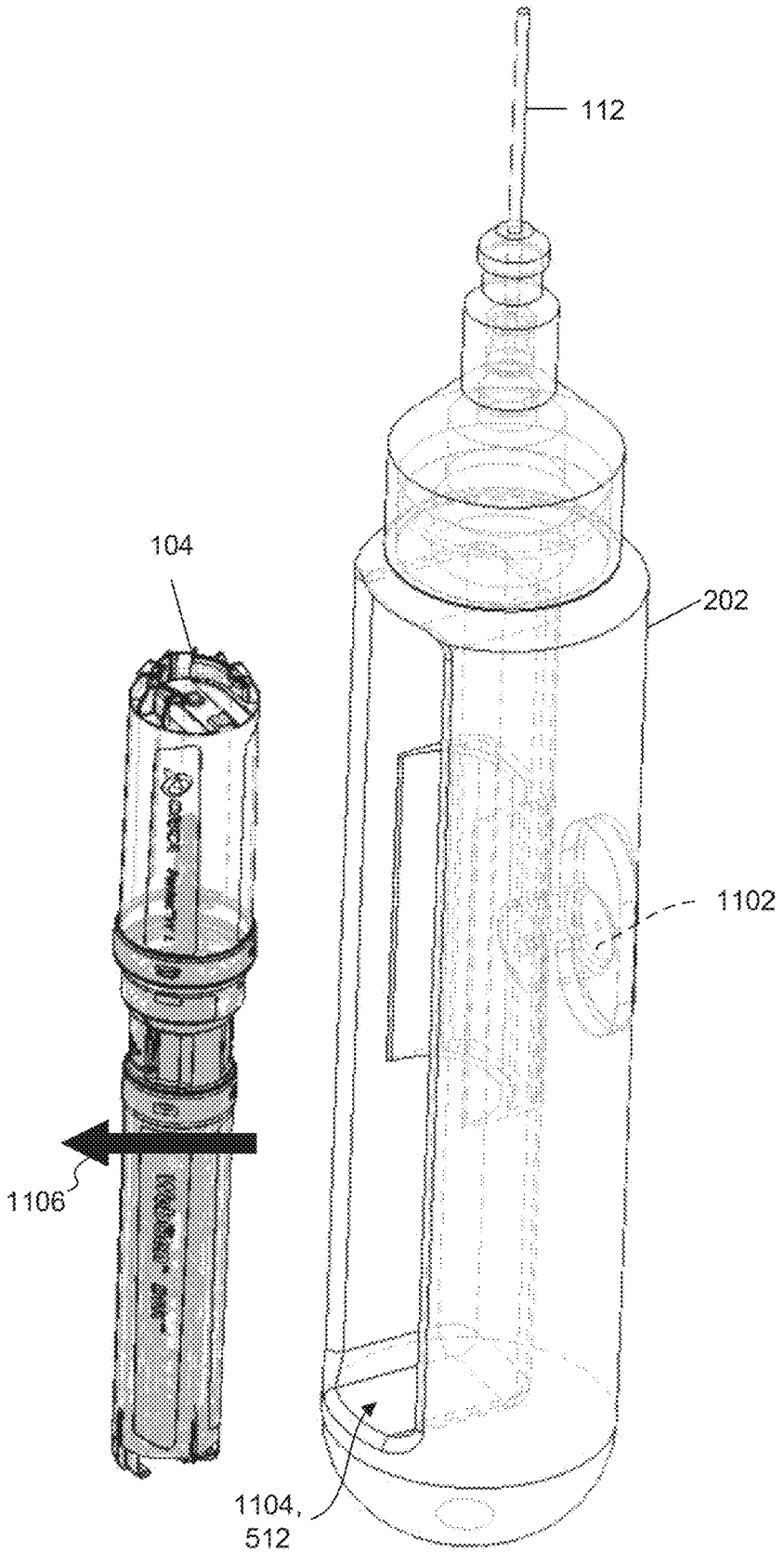
FIG. 11C is a perspective side-view diagram of the deployment device of FIG. 11A (with an internal cavity in broken lines) ejecting the wireless device through the side opening of the deployment device.

In at least one example, as shown in FIG. 11A, FIG. 11B and FIG. 11C:

a. the securing arrangement may include an example electromagnet 1102 arranged, in the internal cavity of the deployment device 202, and at a longitudinal side (i.e., intermediate) of the internal cavity to apply the retaining force to the intermediate portion of the wireless device 104 (optionally including an intermediate adaptor) which includes an example ferromagnetic material (e.g., ferrite plate or permanent magnet), thus applying the side-applied retaining force;

b. the internal cavity can include the side opening formed as a substantially rectangular hole 1104 through which the wireless device 104 is released/ejected in a sideways direction 1106 away from the example electromagnet 1102;

c. the ejecting spring arrangement may include a side spring 1108 (e.g., a coil spring, a compressed elastic/rubber portion (which may include a plastic material), and/or a steel spring with one or more elements shaped to conform to a curvature of the intermediate portion of the wireless device 104), which is compressed/squashed by insertion of the wireless device 104 into the deployment device 202, thus creating potential energy in the side spring 1108 while the wireless device 104 is held by the example electromagnet 1002, and then applying the side-applied ejection force, transverse to the longitudinal axis of the deployment device 202, when the electromagnet 1102 releases the wireless device 104—the ejection force of the side spring 1108 may be substantially 40 to 50 N in the sideways direction 1106; and d. the link 204 may include the example wireline cable 1112 electrically connected to the electromagnet 1102 to provide electrical power to electromagnet 1102 to apply the retaining force (and optionally a portion of the ejection force), thus the example wireline cable 1112 can provide the retaining activation signal (by powering the example electromagnet 1102 to attract the wireless device 104), and can provide the retaining deactivation signal (by depowering the example electromagnet 1102), and optionally can provide the ejection activation signal (by powering the example electromagnet 1002 to generate a magnetic field of opposite polarity to the attracting electric field if the wireless device 104 includes a polarised permanent magnet configured to provide the retaining force and the ejecting force).

The electromagnet, e.g., example electromagnet 1002 or example electromagnet 1102, may be fastened in the internal cavity of the deployment device 202, e.g., by a bolt through the centre of the electromagnet.

Figure 12A:
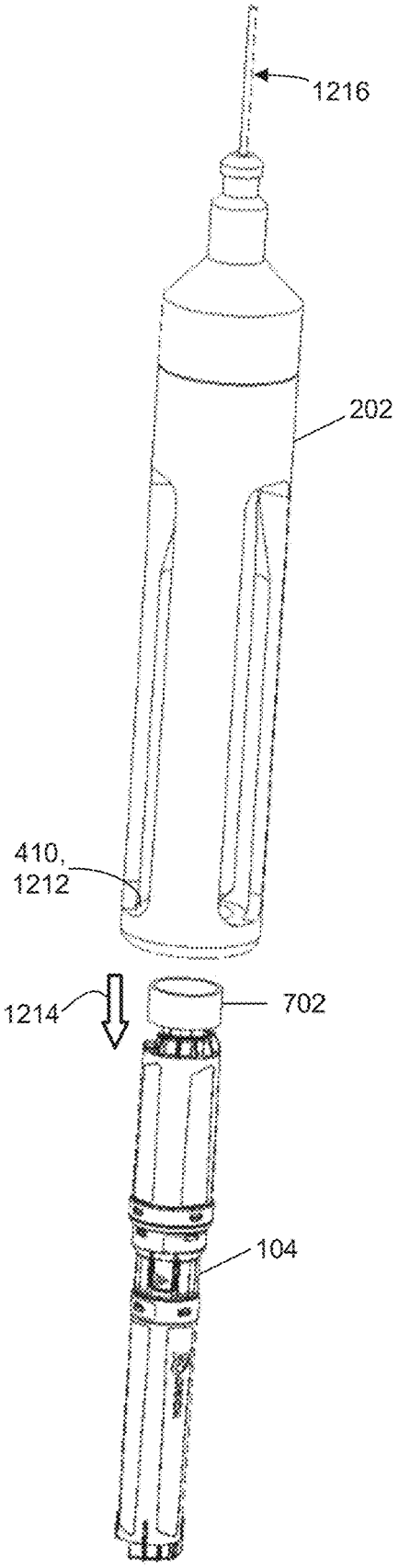
FIG. 12A is a perspective side-view diagram of the deployment device with a fluid opening (for an ejection fluid) at an interior longitudinal end thereof, and the wireless device being ejected through the end opening of the deployment device.
Figure 12B:
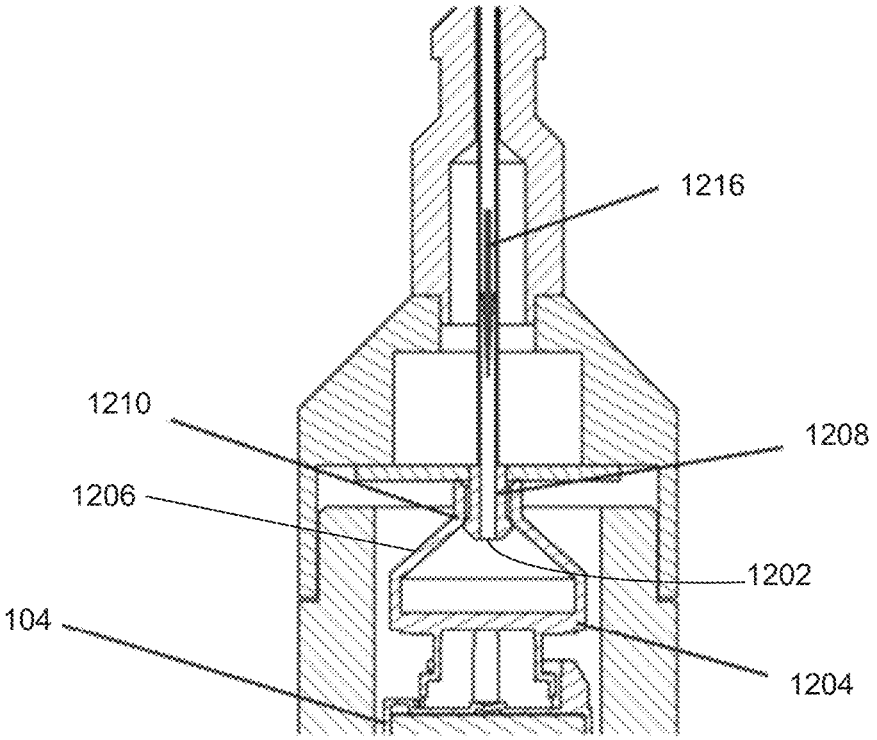
FIG. 12B is a cross-sectional side-view diagram of a portion of the deployment device of FIG. 12A, and a portion of the wireless device in the deployment device.

In at least one example, as shown in FIG. 12A and FIG. 12B:

a. the securing arrangement may include the suction inlet (the fluid inlet/port/mouth/outlet) in the form of an example fluid opening 1202 arranged in the internal cavity of the deployment device 202, and at a longitudinal end of the internal cavity, to apply the retaining force to the end of the wireless device 104 (optionally including an example end adaptor 1204) which includes an example fluid seal 1206 onto which resists the negative pressure leaking out of the deployment device 202—the example fluid seal 1206 may be in the form of the outward facing "cup" (including the resilient walls 912 and the fluid-resistant connection thereof) described with reference to FIG. 9B hereinbefore;

b. the securing arrangement may include a nipple projection 1208 of the deployment device 202, through which an example channel/hose/tube 1216 passes (and which may include an outwardly flared end), and onto which an example gripper 1210 of the securing spring arrangement of the wireless device 104 (and optionally the end adaptor) can be forced by inserting the wireless device 104 into the deployment device 202—the example gripper 1210 may be formed by a resilient mouth/aperture at the end of the wireless device 104, and the resilient mouth/aperture may be formed by the resilient walls 912 forming substantially a circle described with reference to FIG. 9B hereinbefore, such that the example gripper 1210 is stretched around the nipple projection 1208 when loaded, providing sufficient friction to provide the retaining force;

c. the active ejection mechanism may include the example fluid opening 1202 forcing the ejection fluid into the outward facing "cup", e.g., to at least "pop" the example gripper 1210 off the nipple projection 1208, e.g., with an ejection force of substantially 40 to 50 N in the longitudinal direction 1214, e.g., provided by a positive pressure at the ejection outlet of substantially 40 to 60 psi;

d. the internal cavity can include the end opening formed as a substantially circular hole 1212 through which the wireless device 104 is released/ejected in the longitudinal direction 1214 (substantially along the longitudinal axis of the deployment device 202) away from the example fluid opening 1202; and e. the link 204 may include the example channel/hose/tube 1216 in the pressure hose/channel.

Figure 13D:
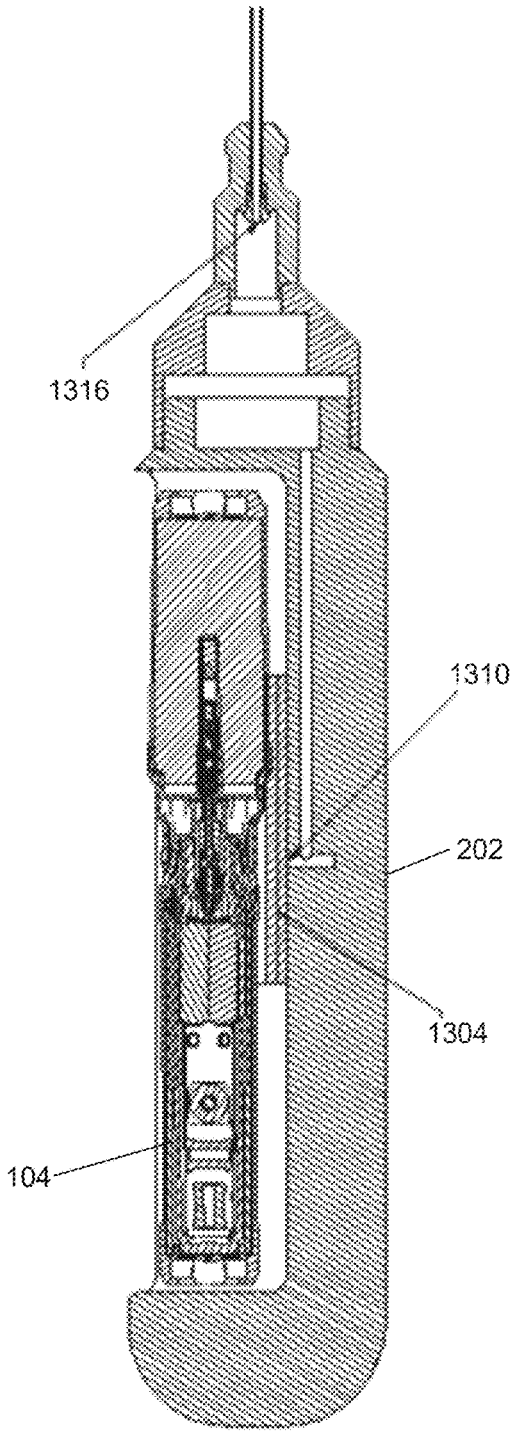
FIG. 13D is a side-view cross-sectional diagram along the line A-A in FIG. 13B.
Figure 13E:
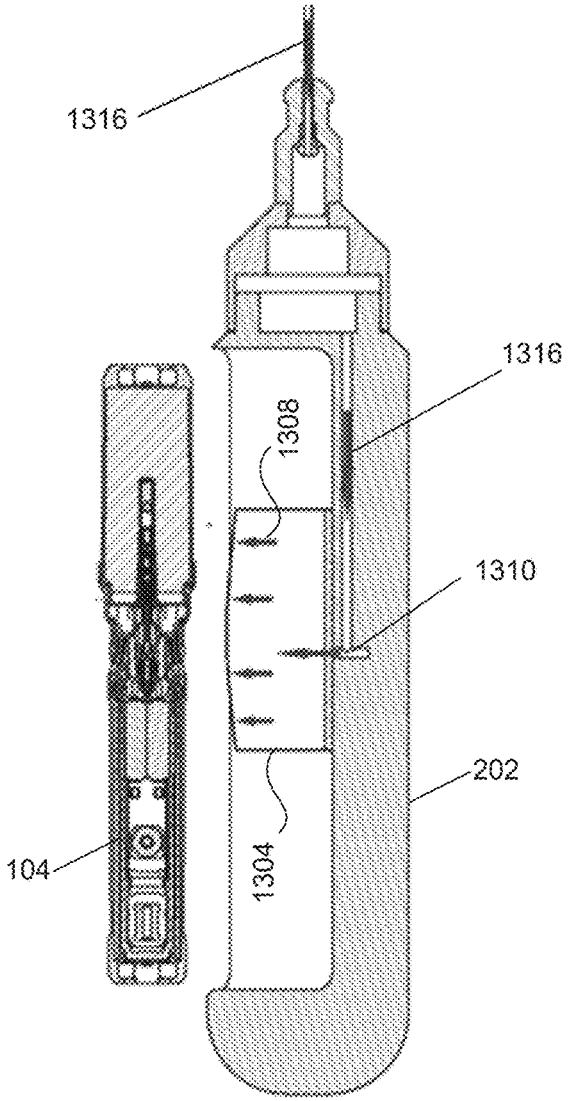
FIG. 13E is a side-view cross-sectional diagram along the line A-A in FIG. 13B showing the deployment device ejecting the wireless device through the side opening and the bladder expanding.
Figure 13F:
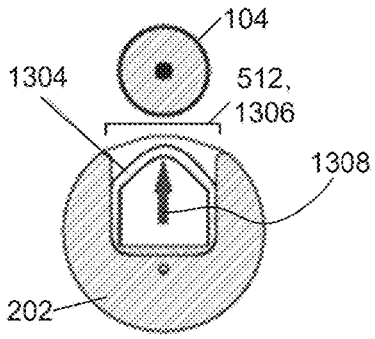
FIG. 13F is an end-view cross-sectional diagram along the line B-B in FIG. 13B showing the deployment device ejecting the wireless device through the side opening and the bladder expanding.
Figure 13G:
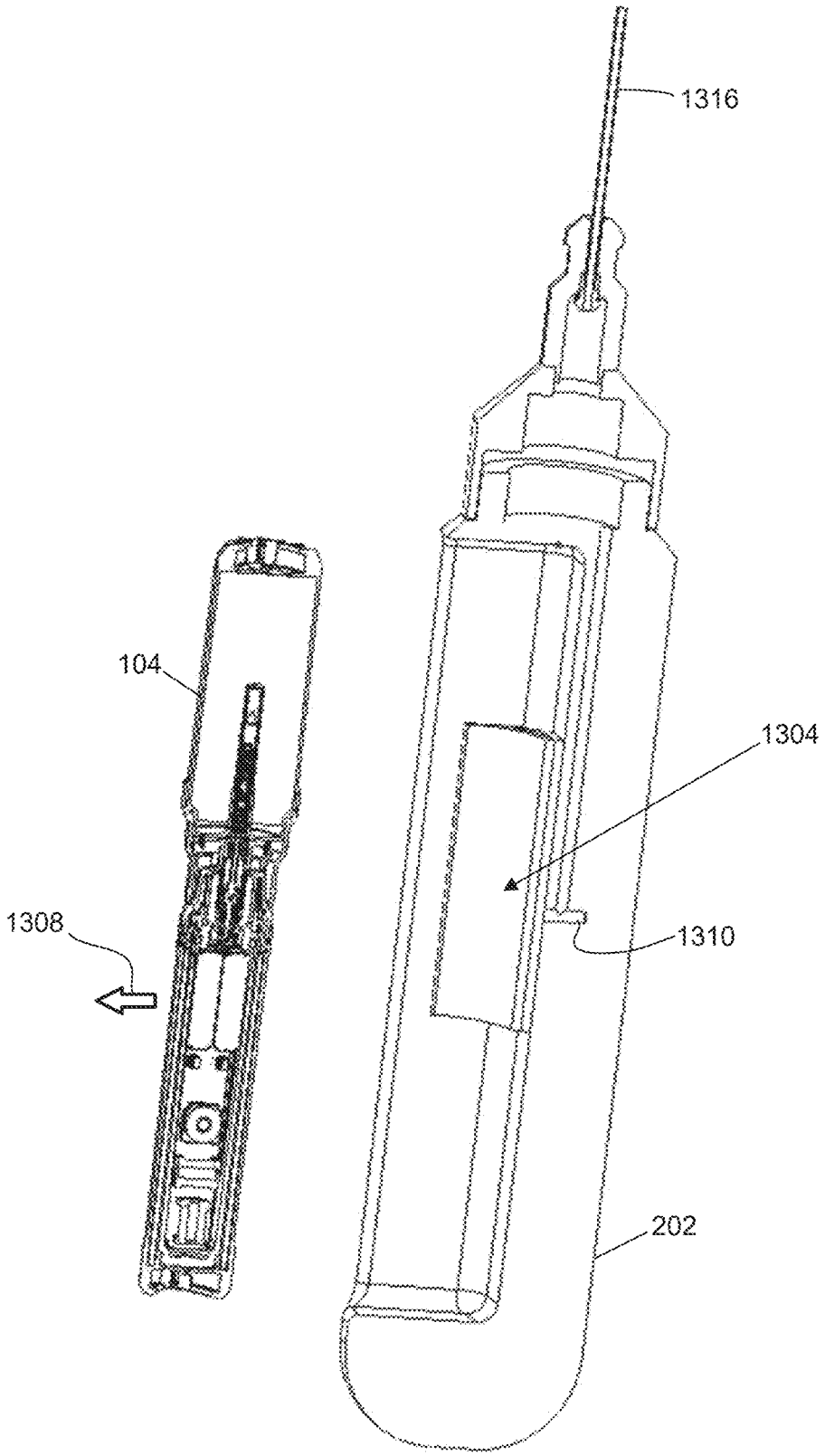
FIG. 13G is cross-sectional side-view diagram of the deployment device of FIG. 13A (with an internal cavity in broken lines) ejecting the wireless device through the side opening of the deployment device; and ee.

In at least one example, as shown in FIG. 13A, FIG. 13B, FIG. 13C, FIG. 13D, FIG. 13E, FIG. 13F and FIG. 13G:

a. the securing arrangement may include the internal cavity of the deployment device 202 including a pair of resilient elements 1302 (which may be portions of a bag or bladder 1304) that apply the side-applied retaining force to opposite sides of the intermediate portion of the wireless device 104 (optionally including an intermediate adaptor) when it is pressed/forced into the deployment device 202;

b. the internal cavity can include the side opening formed as a substantially rectangular hole 1306 through which the wireless device 104 is released/ejected in a sideways direction 1308 away from the example electromagnet 1102;

c. the active ejection mechanism may include an example fluid opening 1310 (which may be referred to as a "ejection fluid outlet") fluidly connected to a sealed bladder 1304 (e.g., formed of rubber), with the example fluid opening 1310 configured to expand the bladder 1304 (to its expanded form that substantially fills the internal cavity as shown in FIG. 13E, FIG. 13F and FIG. 13G) when the positive pressure is applied through an example channel/tube 1316, thus applying the side-applied ejection force sufficient to overcome the securing arrangement—the ejection force of the expanding bladder 1304 may be substantially 40 to 50 N in the sideways direction 1308; and d. the link 204 may include the example channel/tube 1316 in the pressure hose/channel.

In this example, the bladder 1304 is arranged substantially opposite the substantially rectangular hole 1306 such that the ejection force is provided to the intermediate portion of the wireless device 104 substantially towards the substantially rectangular hole 1306. Until the ejection activation signal expands the bladder 1304, it is held in its compressed form by and adjacent to the wireless device 104 as shown in FIGS. 13A, 13C and 13D, optionally by a negative pressure applied through the example channel/tube 1316 and the fluid opening 1310—the bladder 1304 may be compressed/squashed into its compressed form by insertion of the wireless device 104 into the deployment device 202.

In an example, as shown in FIG. 7A and FIG. 7B:

a. the securing arrangement may include passive securing arrangement into/onto which the end of the wireless device 104 (and optionally the end adaptor) can be forced by inserting the wireless device 104 into the deployment device 202—an example gripper may include formed by a mouth/aperture 320 at the end of the wireless device 104, and a cooperating projection 322 from the deployment device 202, through which an end portion of the conduit 302 passes (and which may include an outwardly flared end), wherein the mouth/aperture 320 can be forced onto the cooperating projection 322 (optionally over a resilient element, e.g., a O-ring) to provide sufficient friction to provide the retaining force-alternatively, the wireless device 104 (optionally the end adaptor) can include a cooperating projection 322 for a mouth/aperture of the deployment device 202 through which the end portion of the passes;

b. the active ejection mechanism may include the bulk explosive materials passing into and through the end portion of the conduit 302 to press on the wireless device 104 (optionally the end adaptor), e.g., into an outward facing "cup", e.g., to at least "pop" the mouth/aperture 320 from the cooperating projection 322, e.g., with an ejection force of substantially 40 to 50 N in the longitudinal direction, e.g., provided by a positive pressure from the conduit 302 of substantially 40 to 60 psi;

c. the internal cavity can include the end opening formed as a substantially circular hole through which the wireless device 104 is released/ejected in the longitudinal direction (substantially along the longitudinal axis of the deployment device 202) away from the end portion of the conduit 302; and d. the link 204 may include the conduit 302.

Automatic Loader Apparatus

As shown in FIG. 6, the deploy system 100 may include:

a. a device storage apparatus 1502 (also referred to as a "magazine") configured to store one or more of the wireless device 104 during transport to the borehole 106;

b. an automatic loader apparatus configured to (i) hold the deployment device 202 when it is drawn from the borehole 106 by the hose reel 304; (ii) receive the wireless device 104 from the device storage apparatus; (iii) shuttle/carry the wireless device 104 to the deployment device 202, and (iv) insert/force the wireless device 104 into the deployment device 202; and c. an encoder in a switching box 316 configured to program the wireless device 104, using wireless electronic blasting protocols, such that it is ready for activation.

The device storage apparatus 1502 may be configured to store the wireless device 104 as described in WO2021080514A1 and WO2021080513A1, the original specifications of which are hereby incorporated by reference herein. The device storage apparatus 1502 may store the wireless device 104 in a disassembled condition for safety, and may be configured to assemble the wireless device 104 for transport to the deployment device 202.

The automatic loader apparatus may be configured to: (i) hold/secure the deployment device 202 in the switching box 316 of the deploy system 100 during loading of the wireless device 104; and (ii) release the deployment device 202 to be inserted into the borehole 106. The automatic loader apparatus may include an electromagnet controlled by the deploy control system 208 to reversibly hold the deployment device 202 during device loading. The automatic loader apparatus may detect that the deployment device 202 is secured, in the switching box 316, using a proximity sensor and/or a mechanical stop and/or a length sensor system of the hose reel 304.

The automatic loader apparatus may include a shuttling mechanism 318 (also referred to as a "shuttling device"), e.g., including a chute and/or conveyor belt and/or delivery tube, configured to shuttle/carry the assembled wireless device 104 from the device storage apparatus 1502 to a loading location and/or an encoding location. The loading location or an encoding location may be inside the switching box 316 of the deploy system 100: the switching box 316 is a dust/water resistant box/housing/enclosure configured to protect moving portions of the automatic loader apparatus from dust/water. The switching box 316 may be mounted/arranged in/on a boom head 314 of the deploy system 100, as shown in FIG. 6.

The shuttling mechanism 318 is configured to carry the wireless device 104 to a location/position ("encoding position") adjacent to and within communication range of the encoder (e.g., in the switching box), and the shuttling mechanism 318 is configured and controlled (by the deploy control system 208) to hold the wireless device 104 in the encoding position when the encoder is being controlled (by the deploy control system 208 and/or another connected controller) to program the wireless device 104 (e.g., as described in WO2021080514A1 and/or WO2021080513A1). The encoder may include, or be mounted with, a proximity detector ("wireless device proximity detector") configured to detect that the wireless device 104 is in the encoding position in the switching box 316, and (in response to the detection) to send a signal ("encode now signal") to the encoder (optionally via the deploy control system 208) to control/allow the encoder to start programming the wireless device 104. The proximity detector (or "proximity sensor") may be a non-contact detector including an optical detector and/or near-field detector that detects an object in the encoding position, and optionally a barcode reader and/or radio-frequency identifier (RFID) scanner to read a barcode or RFID of the wireless device 104, e.g., as described in WO2021080514A1 and/or WO2021080513A1. The shuttling mechanism 318 is configured to carry the wireless device 104 from the encoding position to the loading location after the programming: the shuttling mechanism 318 may include an arm to move the wireless device 104 from the encoding position to an adjacent position (e.g., into a rack in the switching box 316) where it is inserted into and/or coupled with the deployment device 202 before being deployed into the borehole 106.

The automatic loader apparatus may include a loading mechanism (or "injection mechanism") configured to load the wireless device 104 to the deployment device 202, under control of the deploy control system 208, by: (i) releasing/guiding the wireless device 104 into the deployment device 202 (e.g., such that the active securing mechanism can pull the wireless device into/onto the deployment device 202); and/or (ii) urging/forcing the wireless device 104 together with into/onto the deployment device 202 (e.g., to load it into a passive securing mechanism), which may be after or before the encoding. (For the active securing mechanism, the deploy control system 208 is configured to engage the securing arrangement to hold the wireless device 104 in/to the deployment device 202 after the wireless device 104 has been delivered in/to the deployment device 202 by the automatic loader apparatus and before the deployment device 202 is moved/removed from the automatic loader apparatus.)

The loading mechanism may include one or more pistons, arms, shuttles, levers and/or air pumps configured to force the wireless device 104 and the deployment device 202 together.

The encoder may include a near field antenna configured to the programming of the wireless device 104, e.g., as described in WO2021080514A1 and WO2021080513A1.

Release Confirmation Sensor

The deployment device 202 includes at least one sensor ("release sensor" or "release confirmation sensor") configured to provide a signal to the control system 208 indicating that the wireless device 104 (e.g., a wireless primer) has been deployed, i.e., has been ejected/released from the deployment device 202 at the predefined/selected operational location.

The release sensor ("wireless device proximity detector") is configured to detect that the wireless device 104 is in/on the deployment device 202, held in place by the securing arrangement (in a "secured position"), and to detect when the wireless device 104 is not in the secured position: thus, the release sensor can detect when the wireless device 104 leaves (and detaches from) the deployment device 202 (when it is ejected/released at the predefined/selected operational location or when it undesirably/uncontrolledly detaches from the securing arrangement), optionally include a time of the detachment. The release sensor is configured (in response to the detection) to send a signal ("device deployed signal") to the deploy control system 208 to indicate that the wireless device 104 has been deployed, and optionally when the wireless device 104 was deployed. The deploy control system can then record when wireless devices are deployed and match this with location information of the deployment device 202 (e.g., based on location information of the extension control mechanism 206 and/or the mechanized platform/vehicle 1504 and/or the depth signal from the depth sensor system) to confirm that the wireless device 104 was deployed in/at its intended/selected predefined/selected operational location (e.g., in the blast plan) and to generate an alarm signal if the wireless device 104 leaves the secure position at a time or location that is not intended/selected (e.g., if the wireless device 104 falls out of the deployment device 202 before the housing is in the borehole 106 and/or before a time of the eject signal (for the ejection mechanism) or the deactivation signal (for the securing arrangement). The release sensor may be a non-contact sensor including an optical detector and/or near-field detector that detects an object in the encoding position, and optionally a barcode reader and/or radio-frequency identifier (RFID) scanner to read a barcode or RFID of the wireless device 104, e.g., as described in WO2021080514A1 and/or WO2021080513A1. The release sensor may include magnetic sensor that detects ferromagnetic material(s) of the wireless device 104 when it is in the secured position. The release sensor may include a switch/button that is held down/up by the wireless device 104 when it is in the secure position, and that is released when the wireless device 104. The release sensor is in electronic communication with the deploy control system 208, including by an analog or digital connection along the wireline cable in the link 204.

Deploy Method

The deploy system 100 is configured to automatically perform/execute the deploy method, e.g., to mitigate manual labour and/or inaccuracies, and/or to provide improved measurements/monitoring in wireless electronic blasting (WEB) operations.

Described herein are deploy and dispense methods (also referred to as "deploying and dispensing methods" or "deploy/dispense methods") for the wireless blasting-related devices in the WEBS for commercial/civil blasting operations, and for delivery of the bulk explosive materials to or into the borehole 106 for blasthole charging.

A deploy method may include:

a. deploying the wireless blasting-related device 104 into the borehole 106, optionally using the conduit 302; and
b. optionally dispensing the one or more bulk explosive materials (optionally in the form of the bulk explosives components) into the borehole 106 using the conduit 302.

The deploy method may include: the deploy control system 208 and the dispense control system 308 communicating to coordinate the deploy method and then the dispense method. This coordination of the dispensing with the deployment may provide safety, speed, precision and efficiency advantages, e.g., in certain blasting operations.

The deploying of the wireless blasting-related device 104 into the borehole 106 may include a deploy method that includes:

a. securing the wireless device 104 in a secured position in/on a deployment device 202 while the wireless device 104 is being moved into and in the borehole 106 to its predefined/selected operational location;
b. holding the deployment device 202 of the wireless device 104 to guide the wireless device 104 into and in the borehole 106 to its operational location;
c. controlling the extension control mechanism 206 and/or the link 204 to guide the wireless device 104 into and in the borehole 106 to its operational location; and
d. ejecting the wireless device 104 from the deployment device 202 when the wireless device 104 is positioned at the operational location in the borehole 106.

The deploy method may include:

a. storing one or more of the wireless device 104 during transport to the borehole 106;
b. receiving the wireless device 104 from the device storage apparatus 1502;
c. programming/encoding by the encoder the wireless device 104 such that it is ready for activation; and
d. inserting/forcing the wireless device 104 into the deployment device 202.

Figure 14:
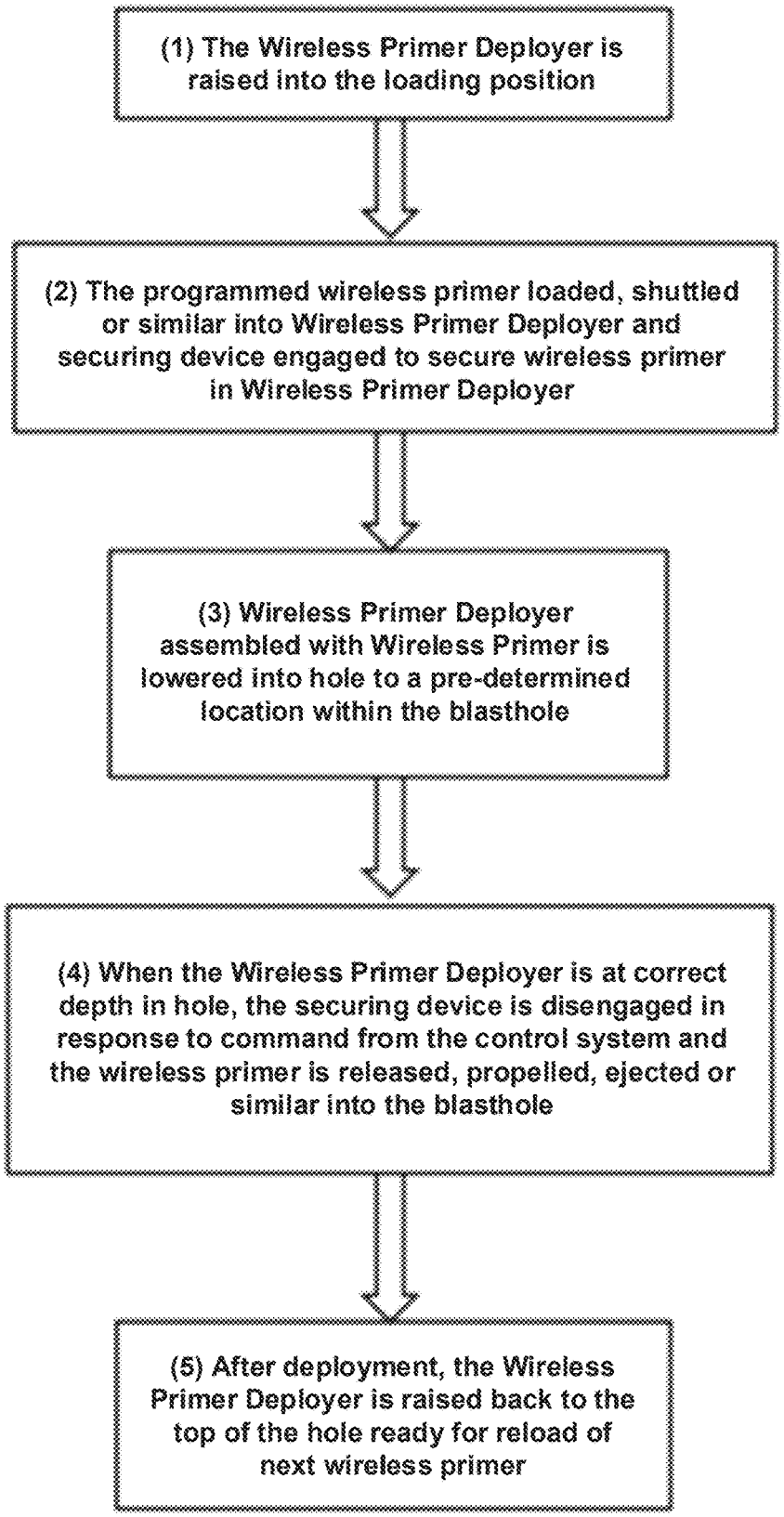
FIG. 14 is a flow chart of a method/process performed by/with the deploy system.

As shown in part in FIG. 14, the deploy method may include:

a. in step (1), in response to a signal from the control system deploy control system 208, the extension control mechanism 206 and/or the link 204 raising, lowering and/or laterally moving the deployment device 202 (which may be referred to as a "wireless primer deployer") relative to the device storage apparatus 1502 to receive the wireless device 104 into the deployment device 202 at a "loading position", e.g., adjacent the shuttling mechanism 318 of the device storage apparatus 1502;
b. in step (2), in response to a signal from the deploy control system 208:
   i. the device storage apparatus 1502 encoding the wireless device 104 and loading the wireless device 104 into the deployment device 202, e.g., by the shuttling mechanism 318, and
   ii. the deployment device 202 securing the wireless device 104 in the deployment device 202 in the secured position;
c. in step (3), in response to a signal from the deploy control system 208, the extension control mechanism 206 and/or the link 204 lowering and/or laterally moving the deployment device 202 with the wireless device 104 to the predefined/selected operational location (e.g., defined in the blasthole plan data) in the borehole 106 based on the depth signals from the depth sensor system;
d. in step (4), in response to a signal from the deploy control system 208, the deployment device 202 deploying (i.e., ejecting/releasing/propelling) the wireless device 104 from the deployment device 202;
e. the deploy control system 208 optionally communicating with the release confirmation sensor to determine if the wireless device 104 has been deployed in step (4); and
f. in step (5), in response to a signal from the deploy control system 208, the extension control mechanism 206 and/or the link 204 raising and/or laterally moving the deployment device 202 out of the borehole 106 ready to load another wireless device 104 and/or be transported (driven) to the next borehole in the blasting plan.

The deploy method may include forcing the wireless device 104 into the grip apparatus. The wireless device 104 would have a pressure rating for product head within the blasthole that is higher than pressures applied to the wireless device 104 by the securing force, or the ejection force.

The dispensing of the one or more bulk explosive materials into the borehole 106 may include a dispense method that includes:

a. carrying the one or more bulk explosive materials to the borehole 106;
b. the hose reel 304 carrying (i.e., "bearing") the conduit 302 to the borehole 106;
c. extending the conduit 203 into the borehole 106 by controlling the hose reel 304;
d. loading the borehole 106 by dispensing the bulk explosive materials when the hose reel 304 has extended the conduit 302 to the operational depth in the borehole 106; and
e. withdrawing (i.e., pulling) the conduit 302 from the borehole 106 after the loading, thus controlling the depth of the conduit 302 along the borehole 106.

The dispense method may include:

a. the nozzle 310 dispensing the bulk explosive materials into the borehole 106;
b. the hose reel 304 controlling the surface location of the conduit 302 perpendicular to the surface of the media 110 (i.e., the downhole positioning of the nozzle at the end of the hose at any point along the blasthole axis); and
c. the boom head 314 limiting uncontrolled movement of the conduit 302 across the surface (so that the conduit 302 remains aligned with the axis 402 during extension, delivery and withdrawal).

In the dispense method, the longitudinal movement may be managed by the truck wheels, by driving forward and backwards. Once the boom head is over the borehole the conduit is dropped into the borehole, regardless of the inclination. The boom head does not need to be angled to manage the conduit in the borehole as the conduit is not rigid.

Applications

The deploy system 100 may provide a hands-free mixing and delivery system for charging and loading blastholes in civil/commercial blasting applications, thus increasing operator safety and/or reducing human errors in blasting. The deploy system 100 may be operated by a person in a cabin of the mechanized platform/vehicle 1504, or by a person remotely controlling the deploy system 100 and the vehicle from a control location safely distant from the blasting area. The deploy system 100 may address the difficulties that are associated with charging and loading a blasthole manually. The deploy system 100 may provide necessary feedback on performance and management of the charging and loading process without operator contact.

The deploy system 100 may substantially/fully automate the deployment of the in-hole wireless devices, including initiators and primers, so they can be operated by a person who is safely distant from the blasting area. The deploy system 100 may provide: improved inventory management (e.g., by tracking/confirming deployment of the wireless devices); loading primers at correct depth; and hands free programming/encoding. Using deploy system 100 in commercial application may reduce the cost of wireless primer charging, e.g., by reduction of the number of operators required to manually deploy wireless primers, e.g., down to three or four to one.

The deploy system 100 is typically reusable, i.e., for many boreholes, and may allow rapid borehole filling, and may reduce blasting waste and consumables, e.g., tether straps and stakes used in traditional blasting deployment techniques.

The deploy system 100 may provide monitoring in real time of what is happening down the blasthole during the deployment and/or the dispensing.

The dispense method may include: measuring of the depth of the blasthole and the presence of water/mud/materials.

Interpretation

The term "commercial blasting operation" includes the initiation and/or detonation of explosive materials or substances disposed in the physical media, e.g., a geological formation, by way of initiation devices as part of mining, quarrying, civil construction/demolition, seismic exploration, and/or another non-military blasting operation. Such initiation and/or detonation explosively blasts, e.g., fractures and/or heaves, or the physical medium in which the commercial blasting operation occurs. Such initiation and/or detonation can be referred to as blasting, in a manner understood by individuals having ordinary skill in the relevant art. The physical medium in which the commercial blasting operation occurs is located in a commercial blasting environment, such as a mining environment, e.g., an open cut or underground mine.

The term "borehole" includes a hole in a set of physical media that can include one or more of rock, broken rock, stone, rubble, debris, gravel, cement, concrete, stemming material, soil, dirt, sand, clay, mud, sediment, snow, ice, one or more hydrocarbon fuel reservoirs, site infrastructure, building/construction materials, and/or other media or materials. The borehole is a narrow shaft that may be bored into media substantially vertically downwards (into a floor, surface or bench), vertically upwards (into a roof), horizontally (into a wall), or at an angle between vertical and horizontal depending on the blast pattern required.

The term "wireless blasting-related device" refers to a device configured for deployment near or in a portion of a physical medium, e.g., a confined space such as a borehole or blasthole formed in the physical medium, wherein the physical medium is intended to be blasted as part of a commercial blasting operation. A wireless blasting-related device does not require or utilize wires that link the device to a non-local or remote control system or apparatus for the transfer of signals, commands, and data between the wireless blasting-related device and the non-local or remote control system or apparatus. Wireless blasting-related devices in accordance with various embodiments of the present disclosure can be configured for bidirectional or 2-way MI based communication. Wireless blasting-related devices include at least some of wireless initiation devices, and wireless markers, and wireless blast monitoring/tracking devices. The wireless blasting-related device can be configured for deployment in a confined space proximate to or in the portion of the physical media. The wireless blasting-related device has a geometry (including shape and size) configured for deployment in the confined space. The confined space can be a borehole, and the geometry can include: a perpendicular width (e.g., diameter for a circular cross section) that is less that a borehole diameter (open diameter of the borehole); and a (longitudinal) length that can be limited by (i) loading manner and optionally (ii) other borehole contents. The device-based MI signal source is configured based on the size of the wireless blasting-related device. The device-based MI signal receiver is configured based on the size of the wireless blasting-related device. The wireless blasting-related device has an electrical charge storage capacity associated with the size: for example, the wireless blasting-related device can be sized to fit into conventional boreholes, e.g., having an average diameter of substantially 4 to 6 cm (for a smaller embodiment) or substantially 10 to 20 cm (for a larger embodiment), and the power storage can be substantially equivalent to two or four commercially available "AA" size batteries (each of which can have substantially 1000 to 4000 milliampere hours capacity, e.g., substantially 3500 mAh for a lithium AA battery). The wireless blasting-related device includes a housing or shell that carries a power source (e.g., a battery and/or a set of capacitors); power management circuitry; at least one control/processing unit providing transistor based circuitry configured for processing instructions/commands, and at least one memory for storing instructions/commands and data; possibly a sensing unit providing a set of sensors configured for sensing or generating signals corresponding to environmental conditions or parameters such as temperature, pressure, vibration, shock, the presence of certain chemical species, light, and/or other conditions or parameters (e.g., in-hole environmental conditions or parameters); an MI based communication unit providing modulation/encoding circuitry coupled to a set of MI signal sources (e.g., one or more coil antennas) in the housing or shell, and demodulation/decoding circuitry coupled to a set of magnetometers (which can include one or more magnetometers, such as one or more types of magnetometers indicated above, corresponding to one or more orthogonal spatial axes) for receiving the MI signals from a remote MI Transmitter (out of the borehole); and optionally an initiation device (e.g., a detonator, or a DDT device), which is configurable or configured for selectively initiating and/or detonating an associated, supplemental, or main explosive charge (e.g., a booster explosive charge) that can be associated with, couplable/coupled to, or contained in the housing or shell. The housing or shell provides a sealed support structure that mechanically houses, carries, protects and/or supports at least pressure and water-sensitive elements of the device, including device-based electronic elements in the device, from impacts and fluid intrusion (e.g., dirty water).

The term "wireless blasting-related device" can include:

a. a wireless marker; and/or b. a wireless initiation device.

The terms "wireless marker", "wireless blast monitoring device," "wireless blast tracking device," and "wireless blast monitoring/tracking device" refer to a device configured for deployment near or in a portion of a physical medium, e.g., a confined space such as a borehole or blasthole within the physical medium, intended to be blasted as part of a commercial blasting operation, and which is configured for generating or facilitating the generation of position or location signals that correspond to, indicate, or identify the device's physical position or location before and/or after the commercial blasting operation. In some embodiments, wireless blast monitoring/tracking devices can include one or more types of sensors that detect, monitor, estimate, or measure particular physical parameters associated with the physical medium in which they are deployed. A plurality of markers may be configured to reside in respective boreholes in which the initiation devices reside, and/or in auxiliary boreholes located proximate to and separate from the boreholes in which the initiation devices reside. A marker can be coupled or attached to an initiation device. A marker can be integrated into an initiation device such that the marker and the initiation device are both within the housing. A marker and the initiation device can be configured to utilize different MI signal frequency bands or frequencies for MI based position localization and MI based communication respectively. The frequencies for MI based position localization may include frequencies between 10 Hz and 10 MHz. A marker can include a receive loop with an average diameter from 0.01 m to 1 m; or a fluxgate magnetometer, SQUID magnetometer, AMR magnetometer, or Hall effect magnetometer. Each marker can be assigned or programmed with its own unique ID. A selected group of markers can be assigned or programmed with a unique GID for that group.

The terms "wireless initiation device" or "wireless explosive initiation device" refer to a device configured for deployment near or in a portion of a physical medium, e.g., a confined space such as a blasthole within the physical medium, intended to be blasted as part of a commercial blasting operation, which is configured for initiating and/or detonating an explosive material, substance, or composition as part of the commercial blasting operation, and which does not require or utilize wires that link the wireless initiation device to an external control apparatus or controller located remote from the wireless initiation device for the transfer of signals, data, and commands between the external control apparatus or controller and the wireless initiation device, but which rather utilizes MI based communication for such signal, data, and command transfer (including controlling the operation and/or firing of selected ones of the initiation devices in association with the commercial blasting operation). In some embodiments, wireless initiation devices can include one or more types of sensors that detect, monitor, estimate, or measure particular physical parameters associated with the physical medium in which they are deployed. A wireless initiation device can include or be a primer, e.g., a primed booster having a booster explosive charge. Each wireless initiation device can include a unique identifier (ID) stored in memory in the initiation device. A group of the wireless initiation devices can include a unique group ID (GID) stored in the memory.

The term "initiation" refers to the initiation or triggering of combustion, a deflagration, a deflagration to detonation transition (DDT), or detonation in a material or substance carrying an explosive composition, and the associated formation of different chemical species, or the initiation of chemical reactions that result in combustion and the associated formation of different chemical species in the material or substance. The term "explosive initiation" refers to initiation giving rise to an explosion or detonation, the occurrence of which corresponds to or is defined by at least some of a rapid energy release, volume increase, temperature increase, and gas production or release, as well as the generation of at least a subsonic shock wave. The term "detonation" refers to the generation of a supersonic detonation wave or shock front in an explosive material or substance, in a manner understood by individuals having ordinary skill in the relevant art.

The term "explosive composition" refers to a chemical composition capable of undergoing initiation and producing an explosion in association with the release of its own internal chemical energy. An explosive composition of appropriate type and/or under appropriate physical conditions may further undergo detonation. The terms "explosive material," and "explosive substance" refer to a material or substance that carries or includes an explosive composition. The term "bulk explosive materials" may include combined bulk explosives components, e.g., tertiary high explosives materials. The bulk explosive materials may include a product formed of bulk explosives components, such as tertiary high explosives materials—for instance, ammonium nitrate prill (AN) and/or ammonium nitrate emulsion (ANE) and/or fuel oil—that are delivered to the borehole by a system for charging blastholes. The bulk explosive materials may include liquid explosive materials and/or solid flowable explosive materials.

The term "wireless electronic blasting system" (WEBS) refers to a system configured for assisting commercial blasting by sending magnetic induction (MI) signals to (and/or receiving MI signals from) the wireless blasting-related devices that are deployable or deployed within portions of at least one physical medium (e.g., a rock formation) intended to be blasted as part of the commercial blasting operation. Such wireless blasting-related devices include wireless initiation devices positioned in boreholes or blastholes, with which a remote MI Transmitter (not in the borehole) communicates as part of enabling/disabling, encoding, querying, (re)programming, (re)synchronizing, and/or controlling the operation and/or firing of particular wireless initiation devices in association with the commercial blasting operation. The WEBS typically includes: (a) at least one wireless device, which can include a primer with a disposable electronic receiver (DRX), a plugin detonator (e.g., iKon) or initiator, and a booster; (b) the encoder (or "encoder controller") that programs the wireless device with delay times and firing codes; and (c) the (above-ground) MI transmitter including a current generator (used to generate TTE signals for the wireless primers), transmitter controller (that sends blasting commands/codes to the wireless primers, including to initiate blasting), and at least one antenna that transmits signals into the earth to the wireless primers.

The communication using the MI signal may be referred to as "through the earth" (TTE) communication or signalling, referring to the communication of signals in, through, and/or across a set of physical media residing between the signal source and the signal receiver or detector, e.g., wherein at least one of the signal source and the signal detector is at least partially obstructed, overlaid, covered, surrounded, buried, enclosed, or encased by the set of physical media. The set of physical media can include one or more of rock, broken rock, stone, rubble, debris, gravel, cement, concrete, stemming material, soil, dirt, sand, clay, mud, sediment, snow, ice, one or more hydrocarbon fuel reservoirs, site infrastructure, building/construction materials, and/or other media or materials.

Herein, reference to one or more embodiments, e.g., as various embodiments, many embodiments, several embodiments, multiple embodiments, some embodiments, certain embodiments, particular embodiments, specific embodiments, or a number of embodiments, need not or does not mean or imply all embodiments.

As used herein, the term "set" corresponds to or is defined as a non-empty finite organization of elements that mathematically exhibits a cardinality of at least 1 (i.e., a set as defined herein can correspond to a unit, singlet, or single element set, or a multiple element set), in accordance with known mathematical definitions (for instance, in a manner corresponding to that described in An Introduction to Mathematical Reasoning: Numbers, Sets, and Functions, "Chapter 11: Properties of Finite Sets" (e.g., as indicated on p. 140), by Peter J. Eccles, Cambridge University Press (1998)). Thus, a set includes at least one element. In general, an element of a set can include or be one or more portions of a system, an apparatus, a device, a structure, an object, a process, a procedure, physical parameter, or a value depending upon the type of set under consideration.

The FIGs. included herewith show aspects of non-limiting representative embodiments in accordance with the present disclosure, and particular structural elements shown in the FIGs. may not be shown to scale or precisely to scale relative to each other. The depiction of a given element or consideration or use of a particular element number in a particular FIG. or a reference thereto in corresponding descriptive material can encompass the same, an equivalent, an analogous, categorically analogous, or similar element or element number identified in another FIG. or descriptive material associated therewith. The presence of "/" in a FIG. or text herein is understood to mean "and/or", i.e., "X/Y" is to mean "X" or "Y" or "both X and Y", unless otherwise indicated. The recitation of a particular numerical value or value range herein is understood to include or be a recitation of an approximate numerical value or value range, for instance, within +/−20%, +/−15%, +/−10%, +/−5%, +/−2.5%, +/−2%, +/−1%, +/−0.5%, or +/−0%. The term "essentially all" or "substantially" can indicate a percentage greater than or equal to 50%, 60%, 70%, 80%, or 90%, for instance, 92.5%, 95%, 97.5%, 99%, or 100%.

Many modifications will be apparent to those skilled in the art without departing from the scope of the present invention.

Throughout this specification and any claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

| Reference signs list | |
|---|---|
| 100 | deploy system |
| 104 | wireless blasting-related device/wireless device |
| 106 | borehole |

-continued

| Reference signs list | |
|---|---|
| 108 | dispense system |
| 110 | media |
| 112 | toe |
| 122 | sensor array |
| 202 | deployment device |
| 203 | conduit |
| 204 | link |
| 206 | extension control mechanism |
| 208 | deploy control system |
| 302 | delivery conduit |
| 304 | hose reel |
| 306 | mixing/delivery system |
| 308 | dispense control system |
| 310 | nozzle |
| 312 | hose boom |
| 314 | boom head |
| 316 | switching box |
| 318 | shuttling mechanism |
| 320 | mouth/aperture |
| 322 | cooperating projection |
| 402 | borehole axis |
| 404 | distal portion |
| 406 | intermediate portion |
| 408 | proximal portion |
| 410 | example end opening |
| 502 | body |
| 504 | wireless-device end |
| 508 | deploy-housing end |
| 512 | example side opening |
| 602 | example end adaptor |
| 604 | mouth/opening |
| 606 | projection |
| 608 | longitudinal axis |
| 610 | O-ring |
| 702 | nozzle holes |
| 802 | longitudinal end portion |
| 804 | longitudinal end portion |
| 902 | head portion |
| 904 | neck portion |
| 906 | lugs |
| 908 | outward facing portion |
| 910 | outward facing opening |
| 912 | walls |
| 1002 | example electromagnet |
| 1004 | example end adaptor |
| 1006 | substantially circular hole |
| 1008 | longitudinal direction |
| 1010 | one or more resilient walls |
| 1012 | example wireline cable |
| 1102 | example electromagnet |
| 1104 | substantially rectangular hole |
| 1106 | sideways direction |
| 1108 | side spring |
| 1112 | example wireline cable |
| 1202 | fluid opening |
| 1204 | example end adaptor |
| 1206 | seal |
| 1208 | nipple projection |
| 1210 | example gripper |
| 1212 | substantially circular hole |
| 1214 | longitudinal direction |
| 1216 | example channel/hose |
| 1302 | resilient elements |
| 1304 | bag or bladder |
| 1306 | substantially rectangular hole |
| 1308 | sideways direction |
| 1310 | example fluid opening |
| 1316 | example channel/tube |
| 1502 | device storage apparatus |
| 1504 | mechanized platform/vehicle |

The invention claimed is:

1. A system for wireless electronic blasting, comprising:

a deployment device configured to secure a wireless device while the wireless device is being deployed into or in a borehole;

a deploy control system in operative communication with the deployment device, the deploy control system configured to control (i) an extension control mechanism to guide the deployment device into or in the borehole, and (ii) the deployment device to release the wireless device at or to a predefined operational location in the borehole, the predefined operational location being located at a selected depth from an end of the borehole at which the wireless device is deployable; and a dispense control system configured to control a dispense system that automatically dispenses one or more bulk explosive materials into the borehole coordinated with the deployment of the wireless device at the predefined operational location.

2. The system of claim 1, wherein the deployment device includes a securing arrangement to secure the wireless device in a secure position in or on the deployment device by applying a retaining force to the wireless device, and wherein the securing arrangement includes (a) a passive securing arrangement that applies the securing force without requiring energy or power; and/or (b) an active securing arrangement that applies the securing force in response to an activation signal.

3. The system of claim 2, further including a depth sensor system configured to provide a depth signal for the deploy control system to automatically determine that the wireless device is at the predefined operational location.

4. The system of claim 1, further including a depth sensor system configured to provide a depth signal for the deploy control system to automatically determine that the wireless device is at the predefined operational location.

5. The system of claim 4, wherein the deployment device is configured to release the wireless device from the deployment device by applying an ejection force to the wireless device to eject the wireless device to the predefined operational location.

6. The system of claim 1, wherein the deployment device is configured to release the wireless device from the deployment device by applying an ejection force to the wireless device to eject the wireless device to the predefined operational location.

7. The system of claim 6, wherein the deployment device includes an ejection mechanism to provide the ejection force, and wherein the ejection mechanism includes (a) a passive ejection mechanism that applies the ejection force with stored potential energy, and/or (b) an active ejection mechanism that applies the ejection force in response to an activation signal with energy from an energy source.

8. The system of claim 1, further including a link configured to hold and guide the deployment device into or in the borehole substantially to the predefined operational location.

9. The system of claim 8, wherein the dispense system includes a delivery conduit configured to carry the one or more bulk explosive materials into the borehole.

10. The system of claim 9, wherein the link includes the delivery conduit.

11. The system of claim 1, wherein the dispense system includes a delivery conduit configured to carry the one or more bulk explosive materials into the borehole.

12. The system of claim 11, wherein the wireless device includes:

a wireless initiation device configured to initiate the bulk explosive materials; or a wireless marker.

13. The system of claim 12, wherein the wireless initiation device is in the form of a wireless primer with a booster explosive charge to initiate the bulk explosive materials.

14. The system of claim 1, wherein the wireless device includes:

a wireless initiation device configured to initiate the bulk explosive materials; or a wireless marker.

15. The system of claim 1, wherein the wireless device is moved into or in the borehole at least partially to the predefined operational location, by way of the deployment device being moved into or in the borehole with the wireless device retained by the deployment device.

16. The system of claim 15, wherein the deployment device is forced, driven, drawn, lowered, and/or raised into or in the borehole with the wireless device retained by the deployment device.

17. The system of claim 1, wherein the deployment device is configured to secure the wireless device while the wireless device is being deployed along the borehole, and the deploy control system is configured to control the extension control mechanism to guide the deployment device along the borehole.

18. A method for wireless electronic blasting, comprising:

securing a wireless device in or to a deployment device while the deployment device is being moved in or into a borehole;

controlling an extension control mechanism to guide the deployment device with the wireless device in or into the borehole; and controlling the deployment device and a dispense system in a coordinated manner so as to, respectively, release the wireless device to a predefined operational location in the borehole and automatically dispense bulk explosive materials into the borehole, and wherein the predefined operational location being located at a selected depth from an end of the borehole at which the wireless device is deployable.

19. The method of claim 18 wherein the securing occurs while the deployment device is being forced, driven, drawn, lowered, and/or raised into or in the borehole.

20. The method of claim 18, wherein the securing occurs while the deployment device is moved along the borehole.

* * * * *